US007249682B2

(12) United States Patent
Lacatus

(10) Patent No.: US 7,249,682 B2
(45) Date of Patent: Jul. 31, 2007

(54) COMPACT CLAMPING CARTRIDGE FOR PANEL-TYPE PRODUCTS

(75) Inventor: Tiberiu Lacatus, Kitchener (CA)

(73) Assignee: 1546300 Ontario Limited, Woodstock (CA)

( * ) Notice: Subject to any disclaimer, the term of this patent is extended or adjusted under 35 U.S.C. 154(b) by 408 days.

(21) Appl. No.: 10/862,814

(22) Filed: Jun. 8, 2004

(65) Prior Publication Data

US 2005/0016894 A1 Jan. 27, 2005

Related U.S. Application Data

(63) Continuation-in-part of application No. 10/730,251, filed on Dec. 9, 2003.

(60) Provisional application No. 60/488,771, filed on Jul. 22, 2003, provisional application No. 60/432,023, filed on Dec. 10, 2002.

(51) Int. Cl.
*A47G 19/08* (2006.01)

(52) U.S. Cl. ..... 211/41.14

(58) Field of Classification Search ..... 211/41.14, 211/41.15, 41.1, 4, 8, 51, 59.3, 69.8, 124; 206/451; 269/43, 236, 38, 105
See application file for complete search history.

(56) References Cited

U.S. PATENT DOCUMENTS 1,454,900 A * 5/1923 Leventry ..... 211/68
2,471,606 A * 5/1949 Burns ..... 24/501
2,946,453 A 7/1960 Pityo
2,953,253 A 9/1960 Henderson et al.
4,093,251 A 6/1978 Boyer
4,202,452 A 5/1980 McCormick
4,501,413 A * 2/1985 Illmann et al. ..... 269/43
4,785,936 A 11/1988 Shpigelman
6,588,605 B1 * 7/2003 Volkert et al. ..... 211/41.14

* cited by examiner

*Primary Examiner*—Sarah Purol
(74) *Attorney, Agent, or Firm*—Jones, Tullar & Cooper, P.C.

(57) ABSTRACT

A clamping cartridge is provided which comprises a plurality of clamping mechanisms spaced apart on a frame or chassis. The clamping mechanisms are generally oriented perpendicular to their direction of spacing. The clamping mechanisms are of the type which comprise a pair of relatively movable jaws which are normally biased towards one another such that they resist opening and which return to a closed or substantially closed condition in the absence of external forces. An actuator operable in association with the clamping mechanisms serves to open and close the jaws of the clamping mechanisms in unison. The actuator includes a series of rotatable tapered cylindrical cam wheels disposed on a rotatable cam shaft to ultimately effect opening and closing of the clamps, which cam wheels are disposed generally within the clamps. By providing apertures or slots in the jaws of the clamps to accommodate the cam shaft, a considerable reduction in the height of the cartridge can be realized. The cam shaft is rotatably supported in bearings and a detachable handle is provided with which the shaft can be rotated. While the clamps are closeable in unison, they are individually self-adjusting so the extent of closure for each clamp is dependent on the thickness or presence of an inserted article. The clamping cartridges are useful in a variety of applications requiring clamping of one or more articles in a side-by-side relationship. One such application is a transportation/storage rack which includes a plurality of aligned horizontal and vertical clamping cartridges for clamping the edges of glass panels.

21 Claims, 26 Drawing Sheets

COMPACT CLAMPING CARTRIDGE FOR PANEL-TYPE PRODUCTS

FIELD OF THE INVENTION

The invention relates to a clamping apparatus for holding and positioning a plurality of items and, more particularly, a clamping cartridge for releasably clamping a plurality of generally planar objects.

BACKGROUND OF THE INVENTION

There are numerous instances where a series of sheet or panel-type products need be transported and/or stored. When all such items are identical, there is usually no need to be concerned over loading and unloading sequences. However, when the items are not identical, any sequenced access must be predetermined which usually entails predetermined loading strategies and, furthermore, random access may simply not be possible. Moreover, where the items vary in thickness, group clamping typically requires individual (i.e. time-consuming) adjustment of respective clamping mechanisms. Existing solutions are either cumbersome, inefficient and/or unable to address all of the user-defined requirements. These requirements and the challenges were, mainly, the following:

- the ability to load a variety of panel sizes and thicknesses within a given packaging unit, for example in a custom metal rack;
- the ability to access, remove or replace any one or all panels individually, without affecting the rest of the panels;
- the ability to grip and hold the parts (panels) during transport and storage;
- user-friendly operating sequences;
- reliability and ease of maintenance; and
- cost effectiveness.

U.S. Pat. No. 2,946,453 describes a supporting rack for automobile windshields having a plurality of pairs of posts, half of which are fixed while the other half are associated with a movable frame so as to enable the movable posts to be moved in unison against the fixed posts to provide a clamping action therebetween.

U.S. Pat. No. 2,953,253 illustrates a windshield carrier having a pair of fixed parallel slotted frames for receiving windshields therein. Clamping is effected either by an associated pair of movable parallel frames having corresponding slots therein (FIG. 1) or a series of pressure elements movable through a linkage (FIG. 8). The devices of both of these patents have unitary movement of all clamping elements, but the fixed spacing structure will only function to clamp the thickest of a plurality of planar articles of variable thicknesses.

U.S. Pat. No. 4,093,251 discloses a windshield carrier having a plurality of posts in two rows. A rotatable friction element is disposed atop each post which can be rotated into engagement with the surface of a windshield disposed between adjacent posts. The friction elements are individually rotatable. This device has the capacity to accommodate a plurality of planar articles of variable thicknesses, but each clamping mechanism must be operated independently.

U.S. Pat. No. 4,202,452 shows a supporting rack for breakable articles comprising a plurality of spaced apart posts in parallel rows. An inflatable tube is provided on the exterior of each post and, thus, between adjacent posts. The tube is inflatable to contact the articles disposed between the posts in a secure and safe fashion. This apparatus has the capacity to accommodate a plurality of planar articles of variable thicknesses and is operable to close and release all clamps in unison. However, the apparatus requires the hydraulic/pneumatic system to be operating/pressurized at all times when clamping is required. Thus, if the system fails, the clamping function ceases.

U.S. Pat. No. 4,785,936 illustrates a device for holding flat objects, such as circuit boards, wherein a plurality of slots are provided in a tray having cooperating blocks with ridges moveable relative thereto. In order to accommodate a variety of thicknesses of boards, resilient cushions are disposed between the ridges which compress to the extent necessary. The device is spring biased in the open position. This device has the capacity to accommodate a plurality of planar articles of variable thicknesses and is operable to close and release all clamps in unison. Like with U.S. Pat. No. 4,202,452, this apparatus is open in its relaxed state.

SUMMARY OF THE INVENTION

A clamping cartridge is provided which comprises a plurality of clamping mechanisms spaced apart on a frame or chassis. The clamping mechanisms are generally oriented perpendicular to their direction of spacing, meaning that the clamping motion of all the clamps is in the direction of spacing so that panel-type products can be clamped in parallel to one another (which is perpendicular to the direction of spacing of the clamps). The clamping mechanisms are normally biased in a closed position or biased against opening and are openable in unison by way of an actuation mechanism in order to permit insertion of an edge of one or more articles to be clamped. While the clamps are also closeable in unison, they are individually self-adjusting so the extent of closure for each clamp is dependent on the thickness or presence of an inserted article.

Preferably, the clamping mechanisms are of the type which comprise a pair of relatively movable jaws which are biased towards one another such that they resist opening and which return to a closed or substantially closed condition in the absence of external forces.

In one embodiment, the jaws are openable by levers which are connectable to or integral with the jaws such that when the end of the levers distal the jaws are moved relatively toward one another, the jaws are caused to open. The actuation levers extend through the frame where they engage a camming mechanism which is operable to urge together respective pairs of levers of each clamping mechanism so as to cause the plurality of clamping mechanisms to open in unison and to permit the respective pairs of levers of each clamping mechanism to separate so as to cause the jaws of the plurality of clamping mechanisms to close or clamp against one or more objects which may have been placed therebetween.

The camming mechanism may comprise a shaft supported by the frame in the direction of spacing of the clamping mechanisms and having thereon a plurality of cam wheels which are fixed to rotate with the shaft. The cam surfaces are disposed on the radial sides of the cam wheels rather than on the circumferential or perimetric edge. The cam surface varies in the axial direction with the revolution of the wheel. A pair of oppositely oriented cam surfaces are provided for each pair of levers of each clamping mechanism. The pair of cam surfaces engage the distal ends of the pair of levers of a clamping mechanism. As the shaft is rotated, the cam surfaces rotate causing the distance between respective pairs of cam surfaces at which the distal ends of the levers are engaged to decrease or increase, thereby actuating the ends of the pair of levers inwardly or outwardly respectively to open and close the jaws of the clamping mechanism.

Advantageously, the cam surfaces between adjacent clamping mechanisms can be provided on a single cam wheel for economy of manufacture.

One embodiment of the clamping mechanisms of the invention comprises a flexible split cylinder-like spring clamp, assembled with two rigid arms that are wider, flat and covered with a protective material (typically rubber dipped) at one end and narrower at the other end. The wider ends are designed to grip the product edge, while the narrow ends are designed to interface with the cam surface.

The clamps are spaced out for a convenient density and mounted on a support frame. A plurality of tapered cylindrical cams are placed underneath the clamps, inside the frame and on one side of each pair of arms. The cams are mounted on a keyed shaft that can be rotated by a handle, wrench or the like.

The rotation of the shaft turns the cams and thus moves the narrow ends of the arms against the springiness (bias) of each clamp, opening it. The distance between the two gripping ends of each pair of arms is at maximum (opening) when the cams have the widest section engaged.

The product(s) can then be introduced. The product is not designed to be seated onto the clamping system, but on a separate structure, that will only support the panels vertically, without any horizontal grip.

The clamp cartridge(s) are usually mounted under the floor level of a larger pack, or rack, or similar storage system. Only the gripping arms are extended upward and above the floor level.

Once product is inserted between the gripping ends of the opened arms, the shaft is rotated 180 degrees and the narrowest portions of the cams are positioned between the arms, thus relaxing the springiness of the clamp to a mere touch.

The gripping ends of the arms naturally move to grip the product, whatever its width. If product is not present, the gripping ands of the arms will move to a light touch (relaxed position). Although the individual clamps are individually biased towards a closed position, the device itself may or may not be normally biased to a closed position.

The operating mechanism of the clamping cartridge, i.e. the opening/closing mechanics, can be implemented in a variety of ways to permit unitary opening of the individual clamps while not restricting the clamps to close in an identical manner.

In this regard, an alternate embodiment of the clamping cartridge is disclosed herein in which the actuating means for opening and closing the jaws of the clamps is located at least in part within the clamps themselves and not below the bottom the clamps, resulting in a much more compact design.

In the alternate embodiment, the clamping cartridge still comprises a plurality of spaced-apart clamping mechanisms oriented generally perpendicular to their direction of spacing. This means that the clamping motion of all the clamps is in the direction of spacing so that panel-type products can be clamped in parallel to one another (which is perpendicular to the direction of spacing of the clamps). The clamping mechanisms are of the type which comprise a pair of relatively movable jaws which are normally biased towards one another such that they resist opening and which return to a closed or substantially closed condition in the absence of external forces.

The alternate clamping cartridge still uses a series of rotatable tapered cylindrical cam wheels disposed on a rotatable cam shaft to ultimately effect opening and closing of the clamps. However, by disposing the cam wheels generally within the clamps and by providing apertures or slots in the jaws of the clamps to accommodate the cam shaft, a considerable reduction in the height of the cartridge can be realized. The cam shaft is rotatably supported in bearings and a detachable handle is provided with which the shaft can be rotated.

Besides being more compact, this embodiment significantly reduces the number of components and simplifies the operation of the clamps. Furthermore, it reduces the amount of rotational input required to effect opening and closing of the clamps. The cartridge is operational to cause the clamps to open in unison and to permit the jaws of the clamps to close or clamp independently against one or more objects which may have been placed therebetween.

The main features and advantages of the clamping cartridges according to the invention are: versatility in typo-dimensional product sequencing and access patterns, simplicity of operation and ease of maintenance.

The operating principles that are believed to be unique to this invention are described by a normally closed or substantially closed, spring based clamping action, self-adjusting grip strength proportional to the product thickness and simultaneous action on all cartridge clamps, regardless of product presence.

While minimum panel spacing depends clamp-to-clamp open position geometry which is a function of maximum thickness and flatness of the panels expected to be accommodated, the overall applicability is only limited by scale factors, as they relate to industrial means of transport and logistics.

In summary of the foregoing, there is provided in one aspect of this invention a clamping cartridge for releasably clamping a plurality of panel-type articles in generally parallel spaced-apart manner comprising:

- a plurality of spaced-apart clamps, said clamps being generally oriented perpendicular to their direction of spacing and each having a pair of relatively movable jaws;
- actuation means operable in association with said clamps for causing the jaws of all said clamps to move in unison relative to one another, said actuation means comprising a cam operable between the jaws of each clamp whereby movement of the cam causes the relative movement of said jaws;
- said jaws being normally biased so as to be individually self-adjusting to the presence of an edge of one or more panel-type articles placed therebetween.

Other features and advantages of the invention will become apparent from the following description and drawings.

BRIEF DESCRIPTION OF THE DRAWINGS

FIG. 5B is an elevational view of the clamping cartridge of FIG. 8A.

DETAILED DESCRIPTION OF THE INVENTION

Figure 1A:
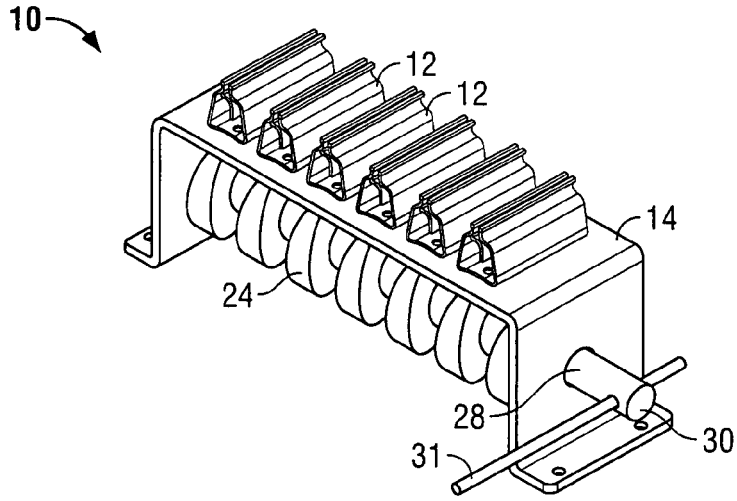
FIG. 1A is a perspective view of the clamping cartridge according to the preferred embodiment of the invention in its closed/clamping position.
Figure 1B:
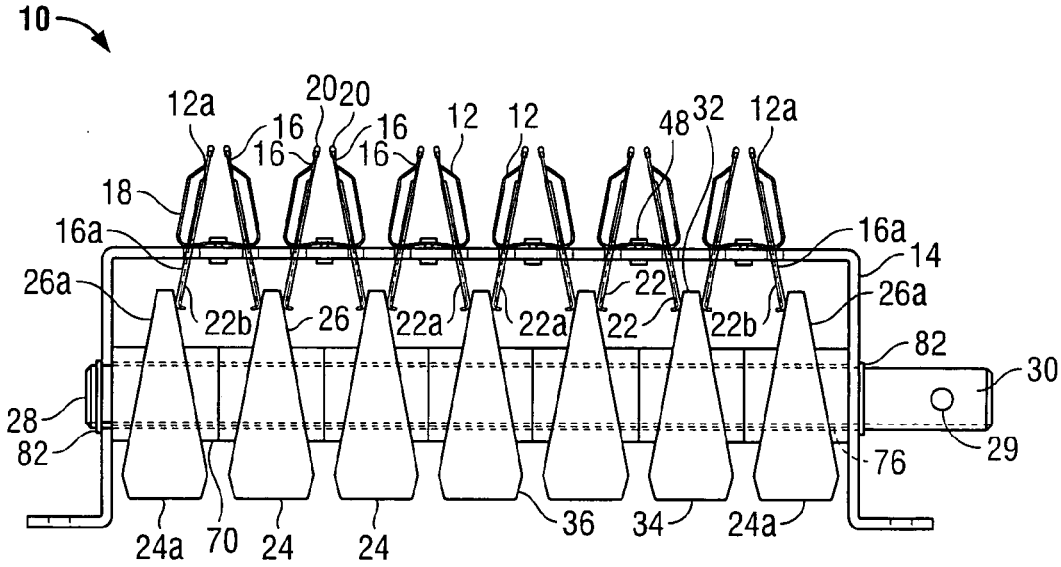
FIG. 1B is an elevational view of the clamping cartridge of FIG. 1A.
Figure 1C:
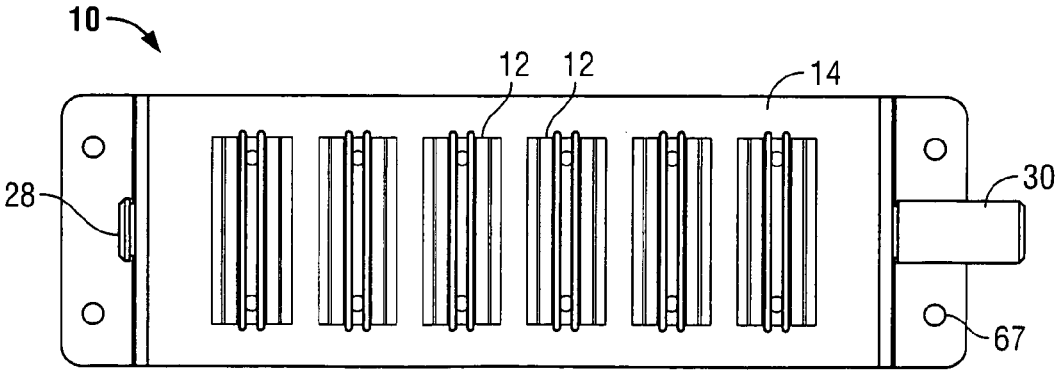
FIG. 1C is a plan view of the clamping cartridge of FIG. 1A.
Figure 1D:
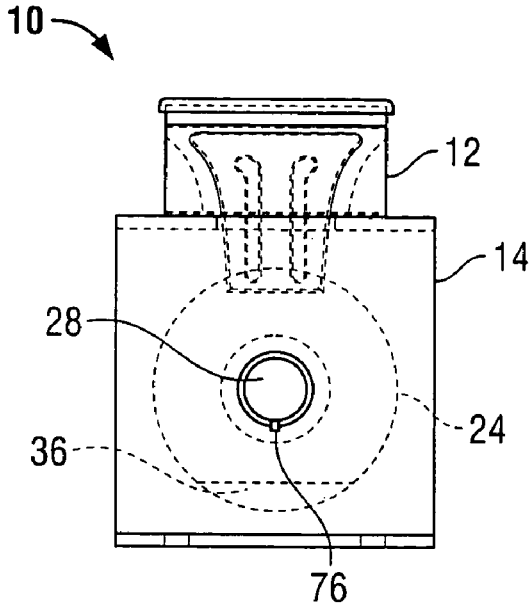
FIG. 1D is an end view of the clamping cartridge of FIG. 1A.
Figure 2A:
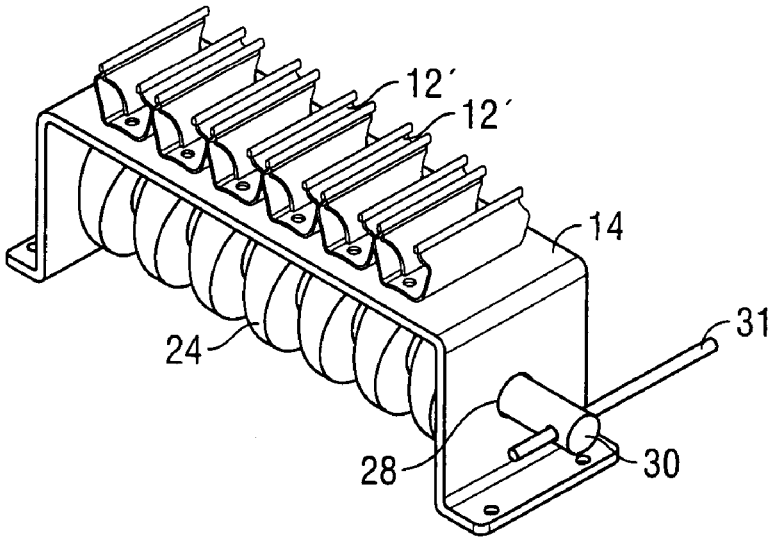
FIG. 2A is a perspective view of the clamping cartridge according to the preferred embodiment of the invention in its open/released position.
Figure 2B:
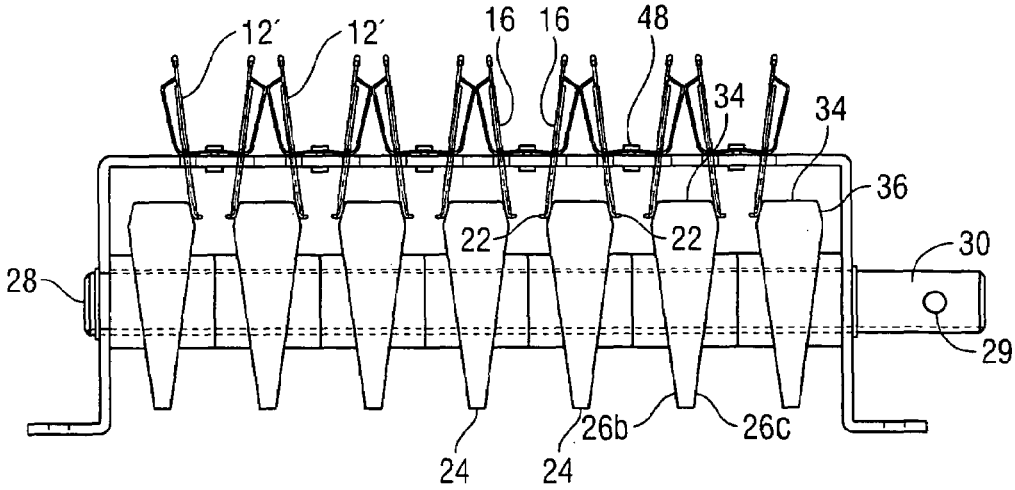
FIG. 2B is an elevational view of the clamping cartridge of FIG. 2A.
Figure 2C:
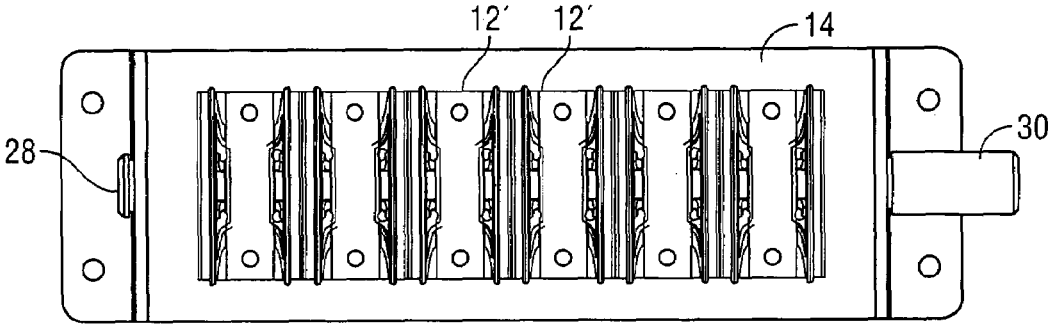
FIG. 2C is a plan view of the. clamping cartridge of FIG. 2A.
Figure 2D:
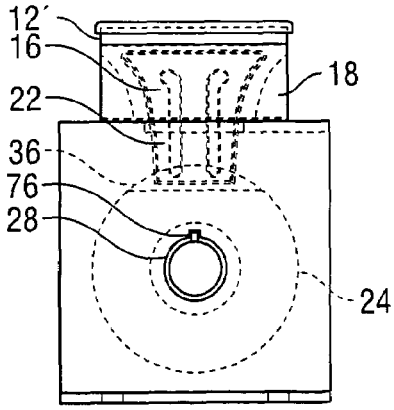
FIG. 2D is an end view of the clamping cartridge of FIG. 2A.

Referring to FIGS. 1A–1D, there is shown an exemplary arrangement of the clamping cartridge 10 according to the invention. The clamping cartridge 10 comprises a plurality of spaced apart clamping mechanisms 12 arranged on a chassis or frame 14. The clamping mechanisms 12 (hereinafter referred to as clamps 12) have a pair of clamping arms 16 which cooperate with a spring clip 18 which urges the upper ends 20 of arms 16 toward one another in a jaw-like fashion. The lower ends 22 of the clamping arms 16 project through the frame 14 and act as levers which when moved relatively toward one another overcomes the spring force of the spring clip 18 thereby causing the clamp 12 to open (as seen in FIG. 2B). The resiliency of the spring clip 18 biases the clamp 12 toward a closed position.

The clamping cartridge 10 also includes means to actuate (open/close) the clamps 12 which preferably comprises a series of rotatable cam wheels 24, each of which having a cam surface 26 in contact with the lower end 22 of a clamp arm 16. The cam wheels 24 are disposed on a rotatable cam shaft 28. Advantageously, the cam wheels 24 can be provided with a cam surface 26 on each side, allowing the cam wheels 24 to be interdigitated between adjacent arms 22*a* of adjacent clamps 12. Accordingly, for any number N of clamps 12, only N+1 cam wheels 24 are required.

The cam shaft 28 includes an extension 30 which can be used to rotate the cam shaft 28 and thus cam wheels 24. The extension 30 may be provided with means to facilitate rotation of the cam shaft 28, such as a knob or handle, or may include a lug which can be engaged by a wrench or similar tool. In the embodiment shown in FIGS. 1A and 2A, a handle 31 is insertable into a transverse aperture 29 (see FIGS. 1B and 2B) to effect leveraged rotation of shaft 28.

The cam surface 26 of the cam wheels 24 is axially and rotationally inclined such that by rotating the cam wheels 24, the point of contact with the lower end 22 of clamp arm 16 effectively translates axially. The cam surface 26 can be that which effectively results from an oblique cutting of a circular cylinder (i.e. a generally elliptical surface) as is the case in the preferred embodiment or could be a helical surface spiraling oppositely from both ends of the cam wheel (not shown).

As shown in particular in FIGS. 6A–6D, the cam surfaces 26 are such as to provide the cam wheels 24 with a thinner section on one side 32 and a thicker section on the opposite side 34. As seen in FIG. 1B, the thinner sections 32 of the cam wheels 24 are disposed between the adjacent lower ends 22*a* of clamping arms 16 permitting maximum opening between the lower ends 22 of each clamp 12 and thus minimizing the distance between or closing (depending on the spatial relationships) the upper ends 20 of each clamp 12. The outermost cam wheels 24*a* are disposed adjacent the lower end 22*b* of the outermost clamp arm 16*a* on outermost clamps 12*a*. While it is not necessary that the outermost surface 26*a* of outermost cam wheels 24*a* be a cam surface, manufacturing efficiencies are achieved in producing a single or minimum number of cam wheel configurations.

Figure 6A:
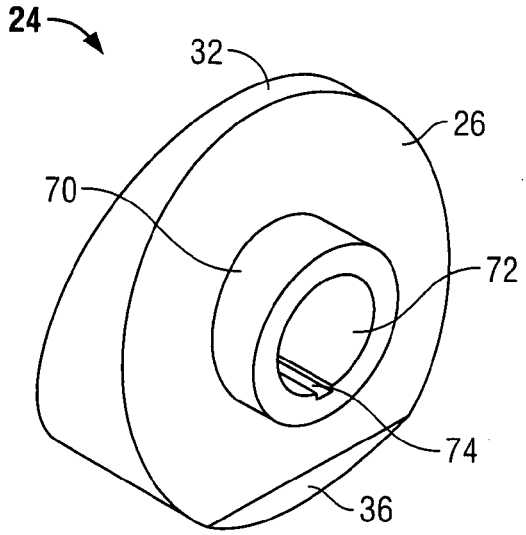
FIG. 6A is a perspective view of one of the cam wheels of the clamping cartridge of FIG. 1A.
Figure 6B:
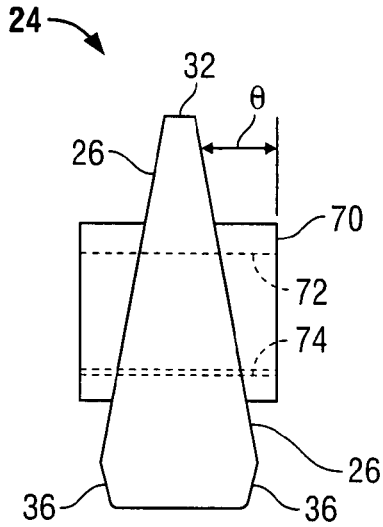
FIG. 6B is an elevational view of the cam wheel of FIG. 6A.
Figure 6C:
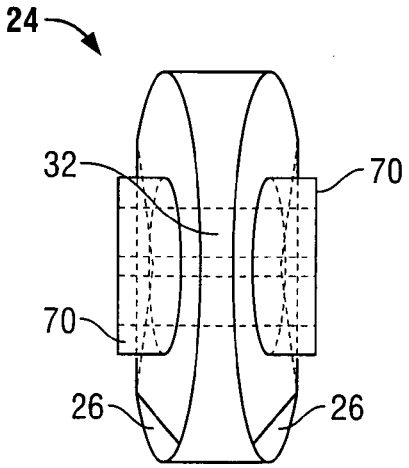
FIG. 6C is a plan view of the cam wheel of FIG. 6A.
Figure 6D:
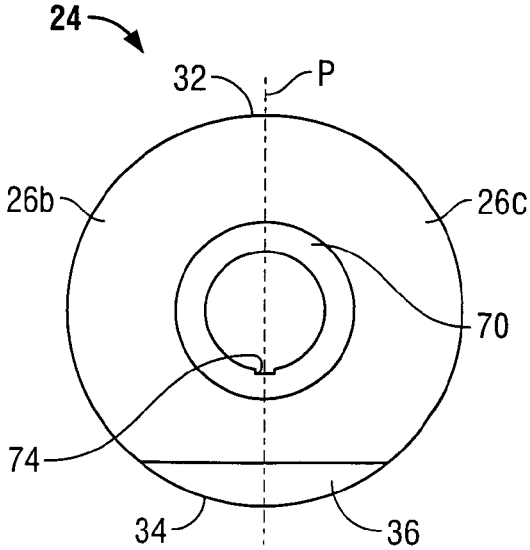
FIG. 6D is a side elevational view of the cam wheel of FIG. 6A.

Referring to FIGS. 2A–2D, when the cam shaft 28 is rotated such as by handle 31, the cam wheels 24 rotate so as to cause an increasingly thicker section thereof to wedge between adjacent lower ends 22 of adjacent clamps 12, thereby actuating the clamping arms 16 and thus opening the clamps 12' in unison. Preferably, the amount of rotation of cam shaft 28 to effect full opening and closing of the clamps 12 is 180° (or less). If the cam surface 26*b*,26*c* on both halves with of the cam wheel 24 is generally the same (i.e. the cam surface 26 is symmetrical about a vertical plane P as shown in FIG. 6D) then such a design will permit rotation of the cam wheel 24 in both directions (clockwise and counterclockwise) with the same effect.

A transverse chamfer 36 may be provided at the thickest section 34 in which the respective lower ends 22 of clamping arms 16 will center and seat when the clamps 12' reach their fully open position. This allows the clamps to "lock" at or near their fully open position to permit items to be inserted into the clamps 12' or removed therefrom. The chamfer also permits closer spacing of the clamps 12, 12' and serves to reduce pressure on the cam wheels 24.

Details of the components of the clamping cartridge 10 are shown in FIGS. 3A to 7D.

Figure 3A:
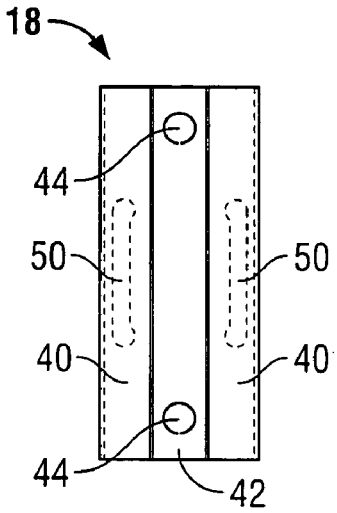
FIG. 3A is a plan view of the spring body of one of the clamping mechanisms shown in the clamping cartridge of FIG. 1A.
Figure 3B:
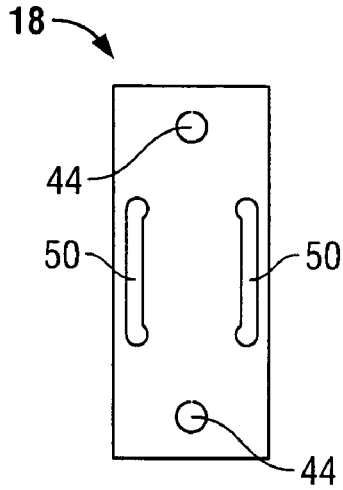
FIG. 3B is a bottom view of the spring body of FIG. 3A.
Figure 3C:
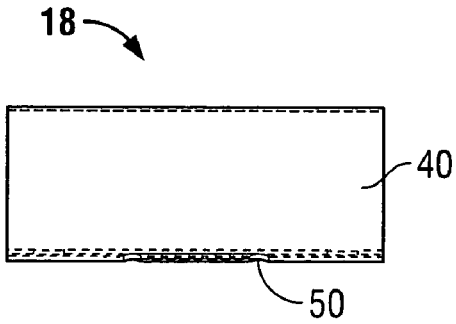
FIG. 3C is an elevational view of the spring body of FIG. 3A.
Figure 3D:
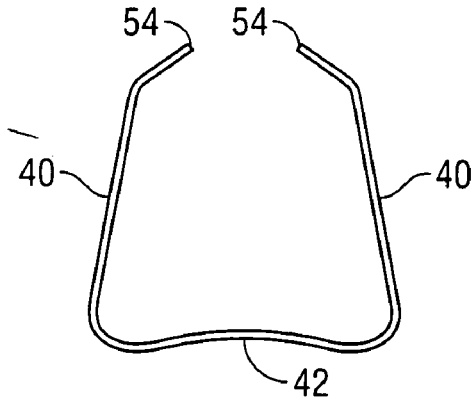
FIG. 3D is an enlarged end elevational view of the spring body of FIG. 3A.

FIGS. 3A–3D show the spring clip 18 the purpose of which in general is to provide biasing which urges the clamp 12 toward a closed or clamping position. The spring clip 18 has a generally U-shaped cross-section as shown in FIG. 3D having a pair of spring arms 40 separated by a bight 42. It will be appreciated that the spring clip 18 can be made in a variety of cross-sectional shapes.

The spring clips 18 are fastened to the frame 14 by any conventional means. In embodiment shown, and pair of holes 44 are provided in the bight 42 while corresponding holes 44 are provided in frame 14 (see FIG. 5A) through which appropriate fasteners 48 (see FIGS. 1B, 2B and 2C) are used to secure the spring clip 18 to the frame 14.

Figure 5A:
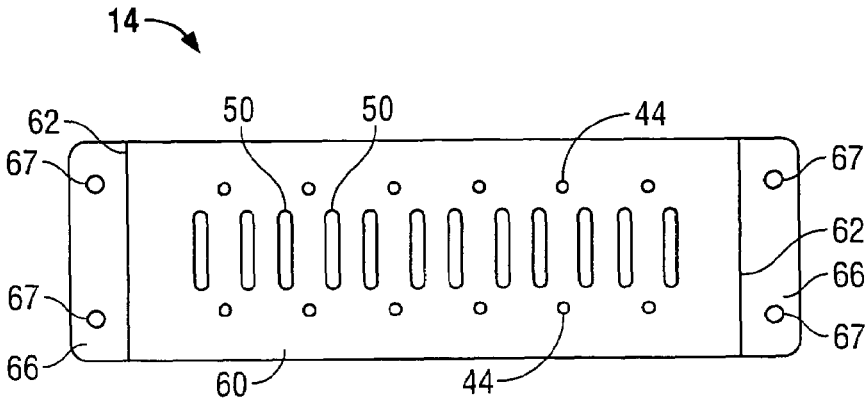
FIG. 5A is a plan view of the support frame of the clamping cartridge of FIG. 1A.

The spring clips 18 are provided with a pair of slots 50 which correspond generally with pairs of slots 52 in frame 14 (see FIG. 5A). The slots 50 accommodate and help retain spring arms 16 while the slots 52 permit the spring arms 16 to extend through the frame 14 (as shown best in FIG. 1B). Preferably, the tips 54 of the spring arms 40 are sufficiently close such that when both clamping arms 16 are disposed within slots 50, the upper ends 20 of the clamping arms 16 are biased together. In FIG. 1B, the upper ends 20 of the clamping arms 16 are shown slightly separated. This is due to the fact that the insertion of the thinner sections 32 of the cam wheels 24 causes a slight pressure on the lower ends 22 of the clamping arms 16, thus causing the slight separation. Preferably, the spring clips 18 are made from known elastic materials such as spring steel.

Figure 4A:
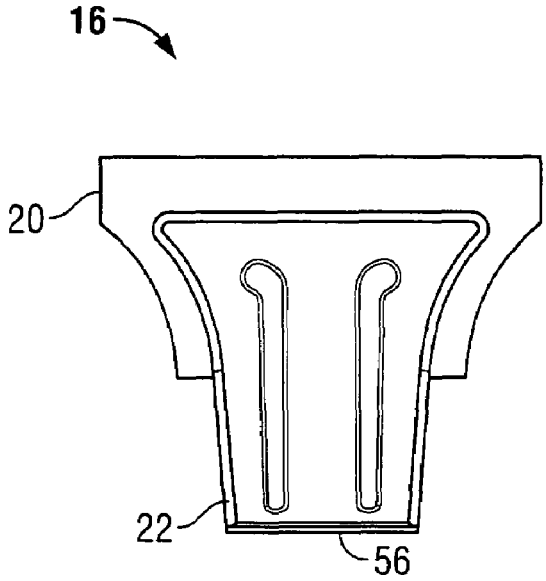
FIG. 4A is a side elevational view of one of the clamp arms of one of the clamping mechanisms shown in the clamping cartridge of FIG. 1A.
Figure 4B:
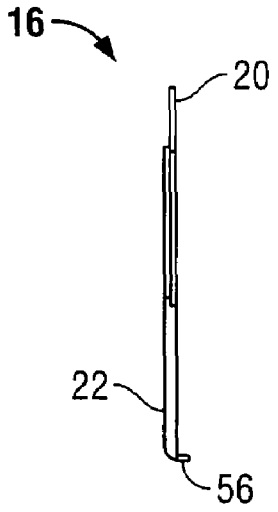
FIG. 4B is an end elevational view of the clamp arm of FIG. 4A.
Figure 4C:
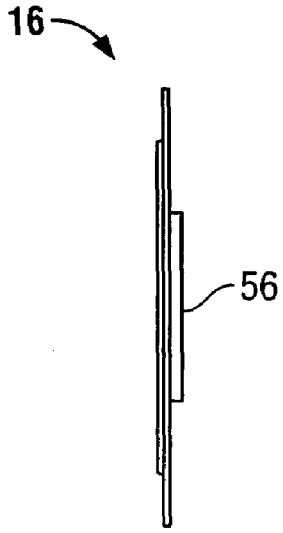
FIG. 4C is a plan view of the clamp arm of FIG. 4A.

FIGS. 4A–4C show one of the spring arms 16 of the clamp 12. The upper ends 20 may be relatively wider than the lower ends 22 to provide extended clamping/gripping support along a portion of the product edge. In this regard, the upper ends 20 may be covered or coated with a protective, high-friction material to reduce possible damage to the product to be clamped and to increase the clamp's gripping capability. For example, the upper ends 20 may be dipped in a liquid settable rubber compound. The lower ends 22 are designed to interface with the cam surface and thus may be provided with a rounded edge 56 to enable slippage to a certain extent. Preferably, the spring arms 16 are made from relatively stiff materials, such as stamped steel, so as to reduce the amount of bending over the force range expected to be encountered.

Figure 5B:
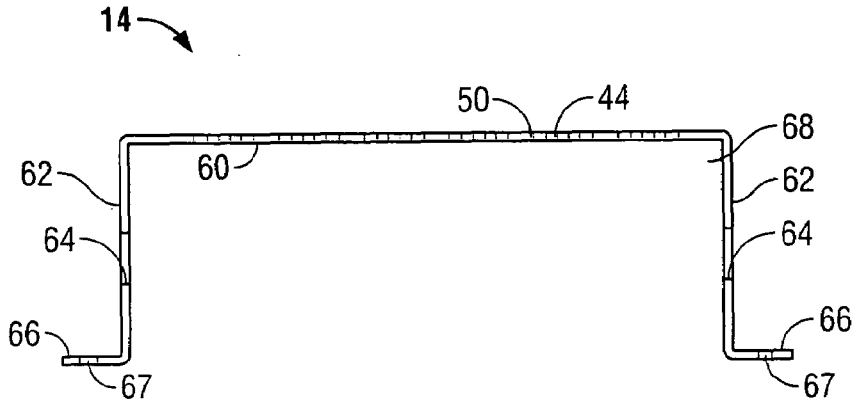
FIG. 5B is a side elevational view of the support frame of FIG. 5A.
Figure 5C:
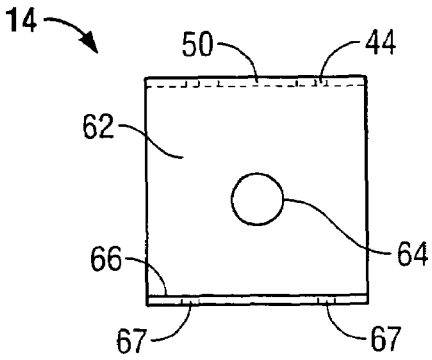
FIG. 5C is an end elevational view of the support frame of FIG. 5A.

The frame 14 is shown in detail in FIGS. 5A–5C. The frame 14 provides the basic supporting structure for the clamps 12 and cam shaft 28 (as shown in FIG. 1B). Thus the frame 14 may be conveniently made by bending an appropriate sheet material into a three sided, rectilinear configuration having an elongated central section 60 and two end sections 62. As aforesaid, the central section 60 includes holes 44 by which the clamps 12 are affixed thereto by fasteners 48 and slots 50 through which the clamping arms 16 of the clamps 12 extend. The end sections 62 each include an aperture 64 in which the cam shaft 28 can be journaled or in which a bearing for the cam shaft 28 can be provided. The frame 14 may also include mounting flanges 66 which include holes 67 for mounting the cartridge 10 where desired. While the preferred frame 14 has been shown with open sides 68 which reduces material costs and facilitates manufacturing thereof, the sides 68 can be closed where it is desired to restrict access to the cam wheels 24 or to inhibit ingress of dust and other foreign matter into the working components of the cartridge 10.

The cam wheel 24 is shown in detail in FIGS. 6A–6D. When viewed along its axis (FIG. 6D), the cam wheel 24 has an outer circular configuration. The cam wheel 24 includes a central bushing 70 and an aperture 72 by which the cam wheel 24 can be mounted on the cam shaft 28. The aperture 72 includes a keyway 74 for accommodating a key 76 (see FIG. 1B) associated with the cam shaft 28 to prevent the cam wheels 24 from rotating relative to the cam shaft 28. The cam angle θ is generally a function of the diameter of the cam wheel 24 and the desired longitudinal movement of the lower ends 22 of the clamping arm 16 (to effect a correspondingly opposite proportional movement of its upper end 20 and hence an opening of the clamp 12).

Preferably, the cam wheels 24 are individual and identical for greater manufacturing efficiency and flexibility. Depending on the length of bushing 70, a cam wheel 24 may abut the bushing 70 of an adjacent cam wheel 24 (as shown in FIG. 1B) or may be relatively free to move along the keyed cam shaft 28, there being a certain degree of self-centering/alignment on account of the clamping arms in the latter case. Still, if spacing between cam wheels becomes significant, (required by panel separation and/or clamp size), washers may be introduced, as a precaution or as a visual enhancement, although they may not be required for the operability of the device. Alternatively, the cam wheels may be made integrally with one another. The cam wheels 24 may be made from any suitable material such as metal (steel, aluminum, etc.), hard plastics, Teflon™, etc. and they can be machined, stamped, injection molded, or any other suitable method of manufacture. The material should provide mechanical robustness, and a reasonable life-time under friction. The materials for the cam wheels 24 and the contacting portion of the clamping arms 22 can be chosen to have a sufficiently high coefficient of friction such that the cam wheels 24 will remain in whatever position they are in when rotation of the shaft is stopped (which may or may not be at top or bottom dead center). Alternatively, the chosen materials can have a sufficiently low coefficient of friction whereby the pressure exerted by the clamping arms 22 on the camming surfaces 26 causes the cam wheels 24 to rotate toward the clamp closed position, thereby resulting in a clamping cartridge which is normally biased in the closed position.

Figure 7A:
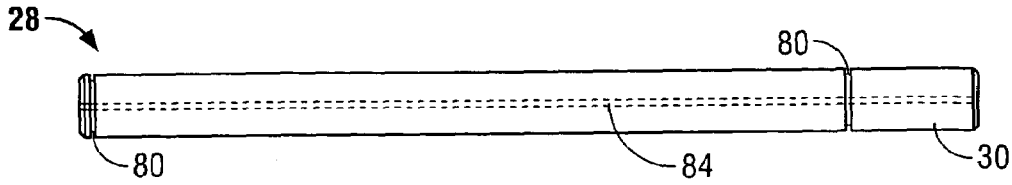
FIG. 7A is a plan view of the cam shaft of the clamping cartridge of FIG. 1A.
Figure 7B:
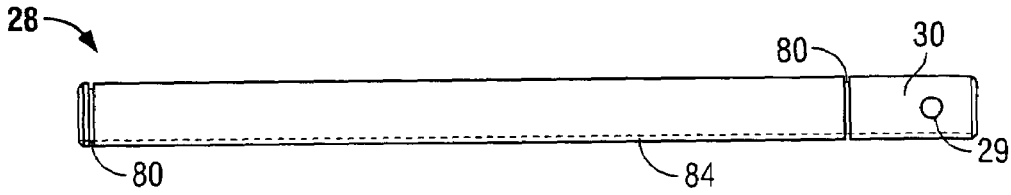
FIG. 7B is an elevational view of the cam shaft of FIG. 7A.
Figure 7C:
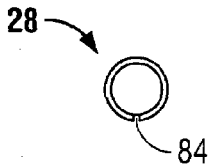
FIG. 7C is an end view of the cam shaft of FIG. 7A.

Lastly, the cam shaft 28 is detailed in FIGS. 7A–7C. The shaft 28 has two annular grooves 80 spaced apart slightly greater than the distance between end sections 62 of frame 14 for accommodating retaining rings 82 (as shown in FIG. 1B). The shaft 28 has a keyway 84 which cooperates with key 76 (as shown in FIGS. 1B and 1D) to enable rotation to be imparted from the shaft 28 to the cam wheels 24. Alternatively, a splined shaft could be provided with the apertures in the cam wheels being correspondingly splined. The shaft 28 may be made from any suitable material typically used for shafts.

Figure 7D:
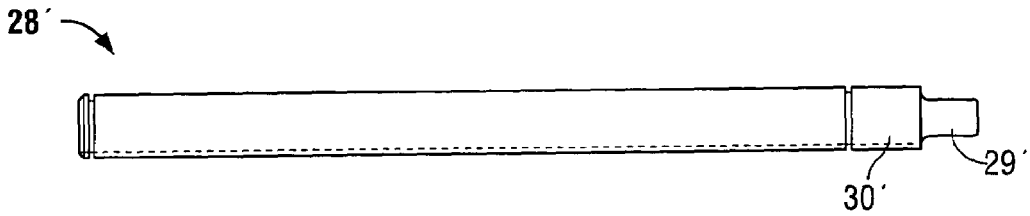
FIG. 7D is an elevational view of an alternate cam shaft having a different mechanism for its rotation.
Figure 7E:
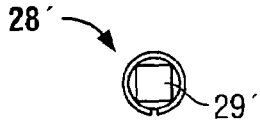
FIG. 7E is an end view of the alternate cam shaft of FIG. 7D.
Figure 8A:
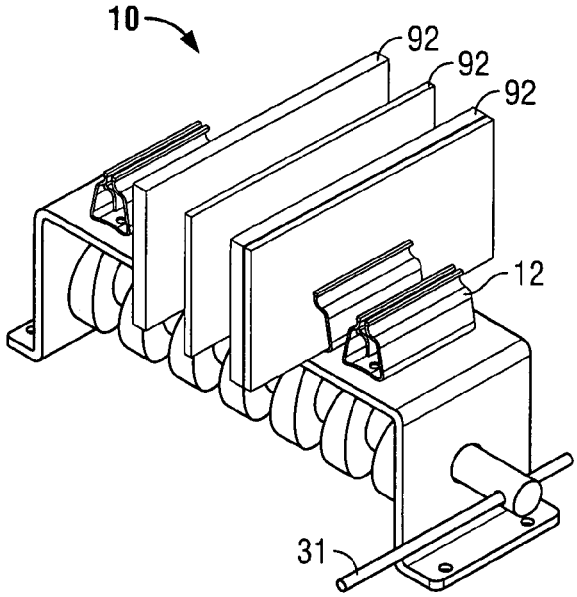
FIG. 8A is a perspective view of the clamping cartridge according to the preferred embodiment of the invention in which a number of panel-type articles have been retained.
Figure 8B:
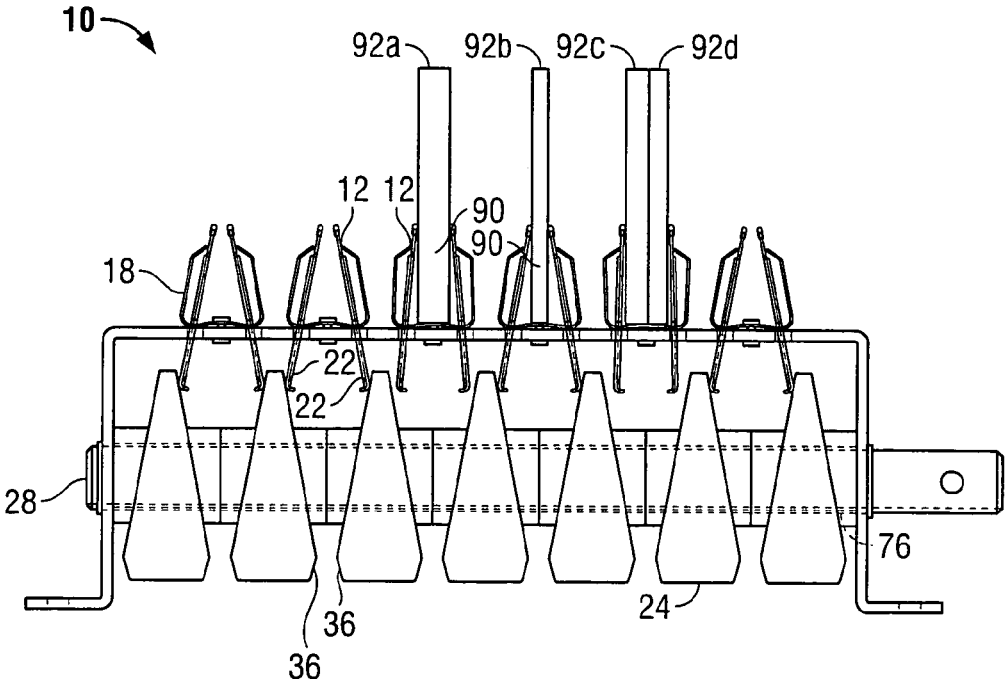
FIG. 8C is a plan view of the clamping cartridge of FIG. 8A.
FIG. 8D is an end view of the clamping cartridge of FIG. 8A.
Figure 8C:
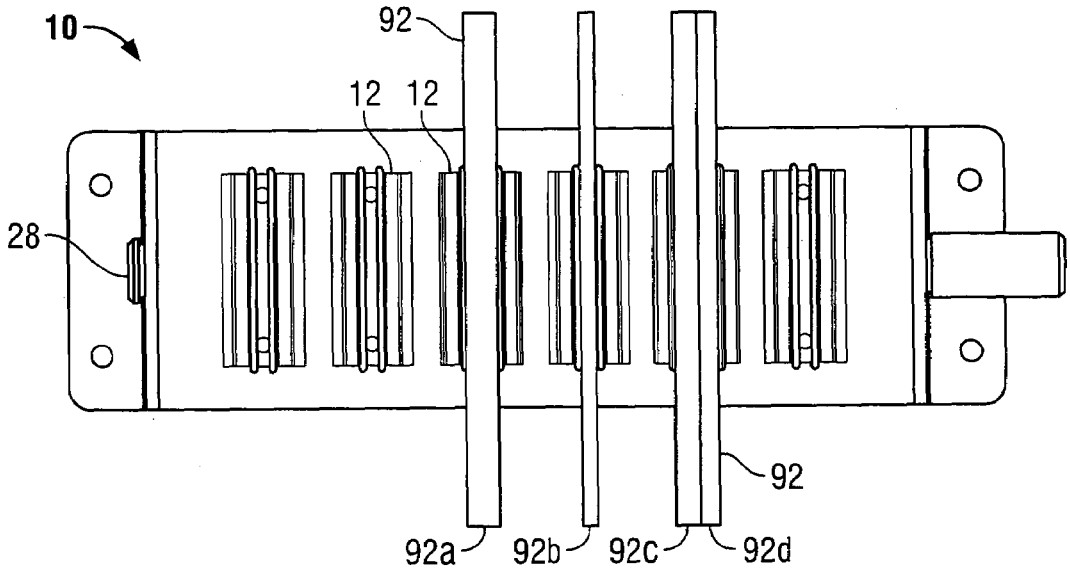
Figure 8D:
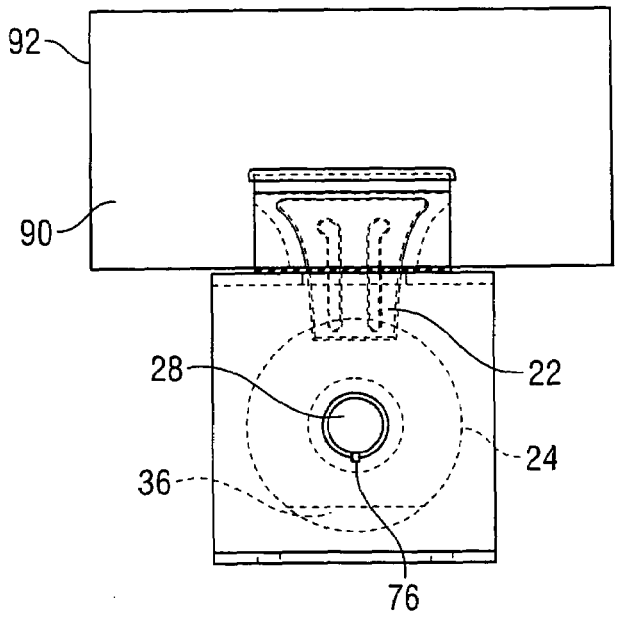

FIGS. 7D and 7E illustrate an alternate mechanism for assisting in the imparting of rotational movement in the form of a lug 29' which is provided on the extension 30' of alternate shaft 28'. A wrench (not shown) is engageable with the lug 29' for rotating the shaft 28'. Any other known mechanism could likewise be employed for manual rotation of the shaft or a power-driven device could easily be substituted.

Referring to FIGS. 1B, 2B and 8A–8D, to operate the clamping cartridge 10, the cam shaft 28 is rotated by the handle means 31, which causes the cam wheels 24 which are keyed to the cam shaft 28 by key 76 to rotate. As the section of the cam wheel 24 disposed between adjacent clamps increases in thickness, relatively speaking, or alternatively, as the distance between the upper ends of adjacent cam wheels 24 decreases, the clamps 12 are urged toward an open position 12' but remain biased against the force of the spring clips 18. As the cam shaft 28 rotates to 180°, the lower ends 22 of the clamping arms 16 self-center against the chamfered edge 36 of the cam wheel 24, thereby retaining the clamping cartridge 10 in its open position. In the cartridge's open position as shown in FIG. 2B, the individual clamps 12' are open to receive a portion of the edge(s) 90 of the panel-like object(s) 92 (shown schematically). One or more panels 92 (having a total thickness less than the design width of the open clamp 12') are positioned in one or more of the open clamps 12' and the cam shaft 28 is again rotated (either through to 360° or back to 0°) to close the clamps 12 against the inserted panel(s) 92. Since each of the clamps 12 are individually biased toward a closed position, the clamps 12 will naturally adjust to the thickness of the retained panel(s) 92 as shown best in FIG. 8B. Accordingly, the clamping cartridge 10 can accommodate a series of different panels comprising panels of different thicknesses 92*a*,92*b* and/or a varying number of panels 92*c*,92*d* of same or different thickness within each clamp 12, as shown in FIGS. 8A–8D. This will permit variability in loading or unloading (i.e. random access) and typo-dimensional sequencing for products retained within the clamping cartridge 10. When release or removal of one or more panels 92 is desired, the cam shaft 28 is rotated 180° in the same manner as aforesaid to open the clamps 12 in unison. When the desired panels have been removed, the cam shaft 28 can be actuated again to close clamps 12 against the remaining panels.

The individual biasing of the clamps 12 can be achieved in a number of ways. The embodiments shown herein employ a clip-type spring although this is not to be considered limiting. The positioning of the spring clip 18 in the aforementioned embodiments is shown to be above the frame 14. However, depending on the nature of the spring or biasing mechanism being used, positioning can be varied just so long as the function remains.

Figure 9:
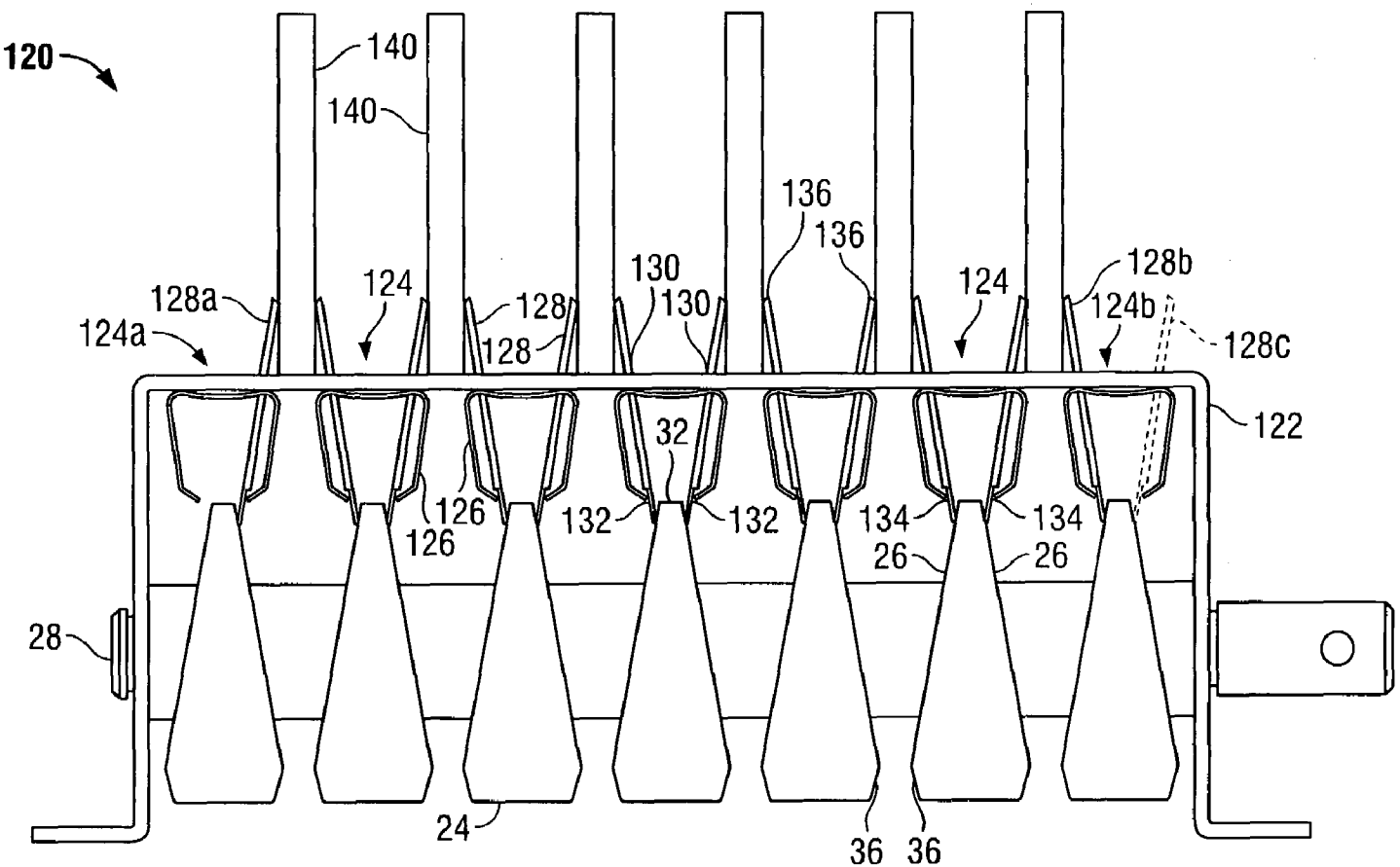
FIG. 9 is an elevational view of an alternate embodiment of the clamping cartridge according to the invention, shown in its closed/clamping.
Figure 10:
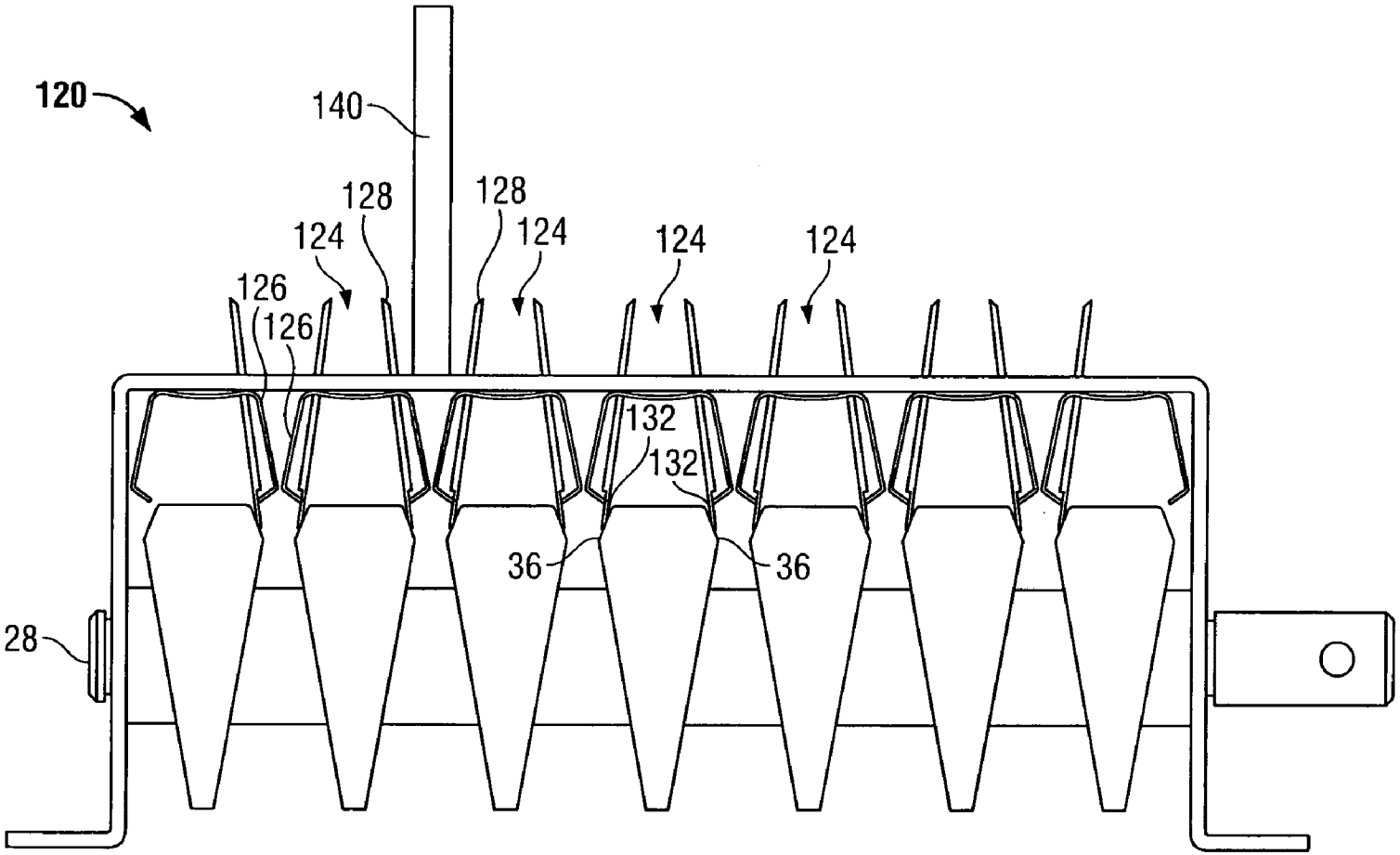
FIG. 10 is an elevational view of the alternate embodiment of the clamping cartridge of FIG. 9 but shown in its position open/released position.

Instead of having the jaws of the clamp used to clamp the article and the clamping arms (levers) bearing on the camming surface of the cam wheels, the clamps can be reversed such that the jaws engage the opposed camming surfaces of the cam wheel and the articles are then clamped between adjacent clamping arms of adjacent clamps as shown in the alternate embodiment illustrated in FIGS. 9 and 10. The alternate clamping cartridge 120 shares many of the same components as the clamping cartridge 10 of FIG. 1A, such as the cam shaft 28 and associated cam wheels 24. The frame 122 is similar but its dimensions may require alteration to accommodate the clamps 124 in their reverse orientation. The clamps 124 are disposed such that their spring clips 126 are beneath the frame 122 and with their arms 128 extending thereabove through the slots 130 in the frame 122. The thin section 32 of the cam wheels 24 are positioned between the jaws 132 of the clamps 124 such that the tips 134 of the clamping arms 128 engage the opposed camming surfaces 26 of the cam wheels 24. As the shaft 28 is rotated, the portion of the cam wheels 24 between the jaws 132 becomes increasingly thicker, relatively speaking, causing the distal ends 136 of the arms 128 of each clamp 124 to move relatively toward one another and hence away from the distal end 136 of the adjacent arm 128 of the adjacent clamp 124. Continuing the rotation to 180° as shown in FIG. 10, the jaws 132 over-center onto the chamfers 36 to "lock" into an opened position. Panels 140 which may have been disposed between adjacent arms 128 of adjacent clamps 124 are then removable. Alternately, panels 140 may be situated between adjacent arms 128 of adjacent clamps 124 whereupon rotation of the shaft 28 (either through to 360° or back to 0°) returns the thinner section 32 of the cam wheels 24 to between the jaws 132, relaxing/reducing the tension on the spring clips 126, and reducing the distance between the distal ends 136 of the adjacent arms 128 of the adjacent clamps 124, which effectively permits them to act as clamps.

The outermost clamps 124*a*,124*b* as shown in FIG. 9, may include only one clamping arm 128*a*,128*b*, respectively, as an outermost clamping arm 128*c*, shown in phantom, would be unnecessary in this arrangement. However, an outermost arm 128*c* could be provided. It can be seen that the alternate clamping arrangement 120 requires the same number of clamps 124 as cam wheels 24. However, the number of cam wheels 24 is still one greater than the number of clampable articles 140 as the clamping function is based on the spacings between adjacent clamps 124.

Referring to FIGS. 11–22, there is shown an alternate, more compact clamping cartridge 210 according to the invention which employs a similar camming mechanism to effect unitary opening and closing of the individual clamps.

Cartridge 210 comprises a plurality of spaced apart clamping mechanisms 212 (detailed in FIGS. 15A–15C) arranged transversely on a supporting chassis 214. The clamping mechanisms 212 (hereinafter referred to as clamps 212) have a pair of clamping arms or jaws 216 which are normally inwardly biased (for example, if made of spring steel or the like) so that the tips 217 thereof converge together so as to close or substantially close the clamp 212 in the absence of external forces. The individual clamps 212 are secured to the chassis 214 by means of a pair of retainers 248 (detailed in FIGS. 16A–16D) and suitable fasteners 249, such as screws or bolts, which secure the bight 242 of the clamp 212 to the chassis 214 as will be described in more detail hereinafter.

The actuating means for opening and closing the jaws 216 of the clamps 212 is located at least in part within the clamps 212 themselves and not below the bottom or bight 242 of the clamp 212, resulting in a much more compact design. The clamping cartridge 210 still uses a series of rotatable tapered cylindrical cam wheels 224 (detailed in FIGS. 17A–17D) disposed on a rotatable cam shaft 228 (similar to cam wheels 24 and cam shaft 28 in the FIG. 1 embodiment). However, by disposing the cam wheels 224 within the clamps 212 and by providing apertures or slots 243 in the jaws 216 of the clamps 212 to accommodate the cam shaft 228, a considerable reduction in the height of the cartridge 210 can be realized.

The cam shaft 228 (detailed in FIGS. 18A–18D) is rotatably supported in bearings 264 within bearing blocks 262 (detailed in FIGS. 19A–19D) which are mounted to chassis 214 by suitable fasteners 263, such as screws or bolts. A detachable handle 231 is provided which is engageable with shaft 228 to effect leveraged rotation thereof.

Figure 11:
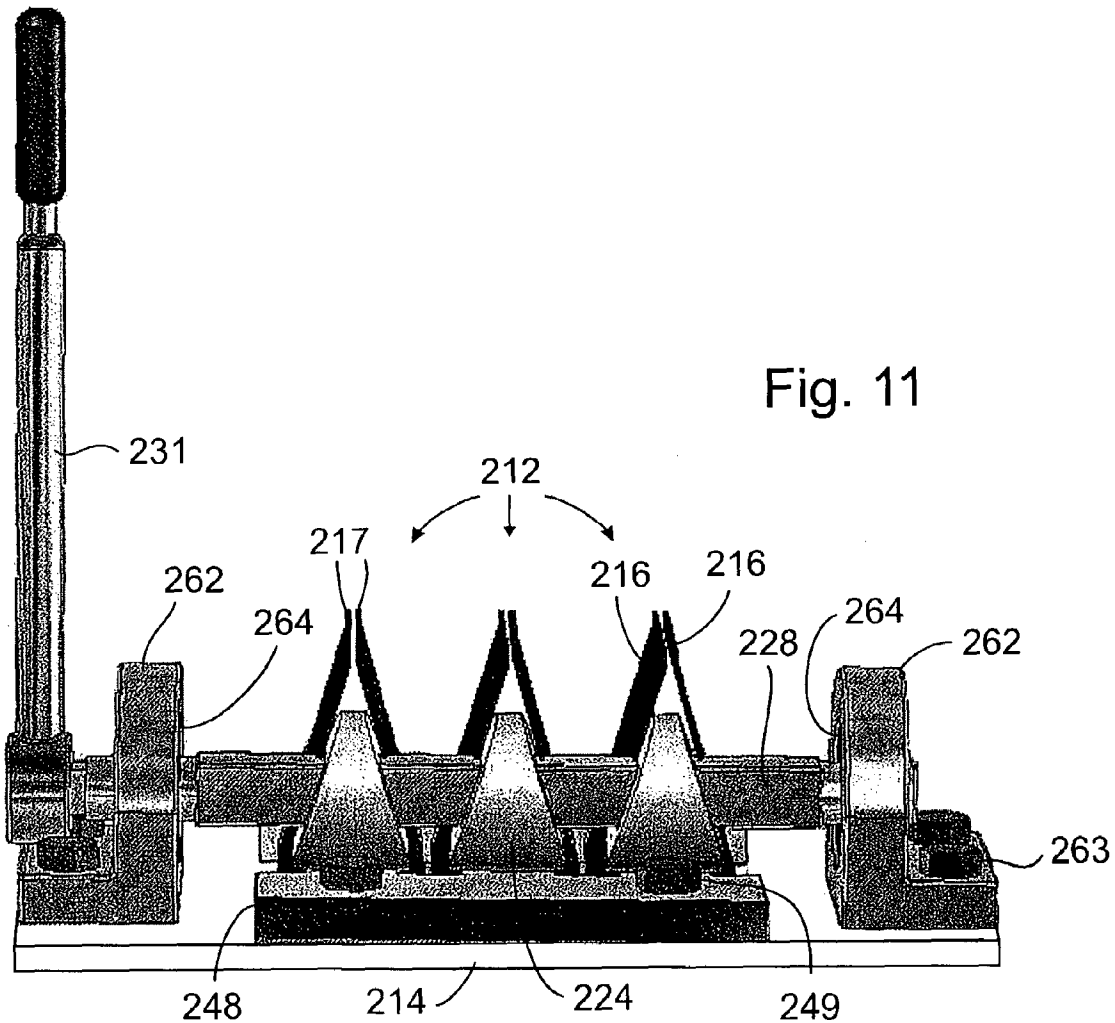
FIG. 11 is a front perspective view of the compact clamping cartridge according to the alternate embodiment of the invention, shown in its closed condition.
Figure 20:
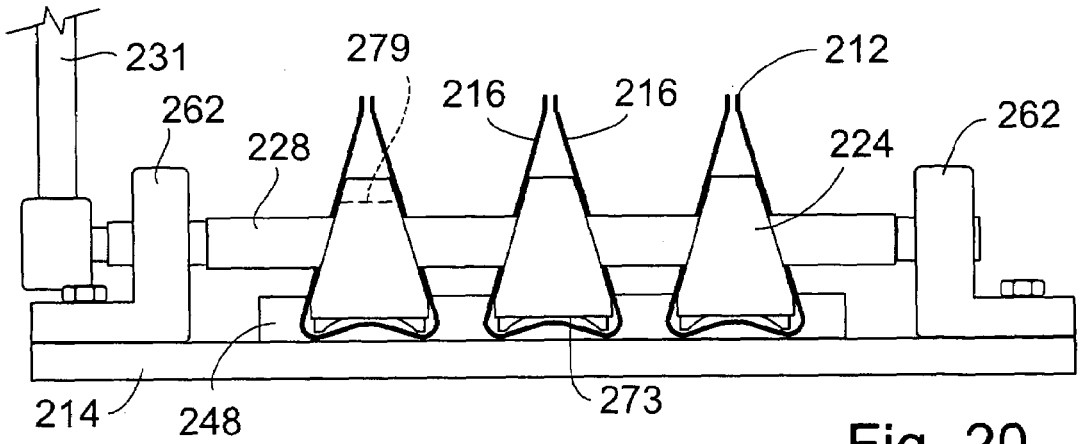
FIGS. 20, 21 and 22 are elevational views of the compact clamping cartridge, with the clamp retainer in the foreground removed for the purposes of illustrating the operation of the compact clamping cartridge.

Details of the components of this alternate embodiment are illustrated in FIGS. 15–19. The preferred configuration of the clamp 212, which is shown in FIGS. 15A–15C, comprises a modified spring clip, typically made from spring steel. The clamp 212 has a central bight 242 from which a pair of jaws 216 extend therefrom so that their tips 217 converge towards one another. With these clamps 212, the width of the bight 242 is greater than the expected width of the panels to be accommodated within the clamps 212. The tips 217 may be covered or coated with a protective and/or frictional material 219 (typically rubber dipped). The slots 243 extend in from corresponding sides of the jaws 216 and are of sufficient width to accommodate the cam shaft 228 during rotation. Corresponding through holes could be used in lieu of slots 243, however, slots are preferred for ease of assembly. In their relaxed configuration, these clamps 212 have a generally triangularly configured cross-section which is well-adapted to accommodate the shape of the tapered cylindrical cam wheels therein as seen in FIG. 11 or FIG. 20.

Figure 16A:
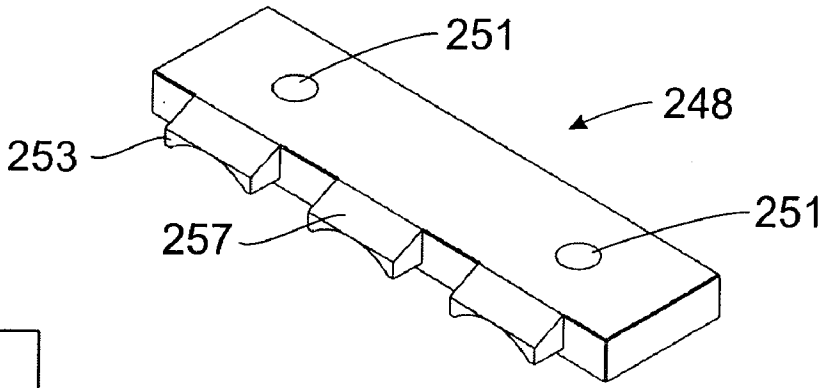
FIG. 16A is a perspective view of one of the retainers of a pair used to secure and position the clamps in spaced-apart fashion.
Figure 16D:
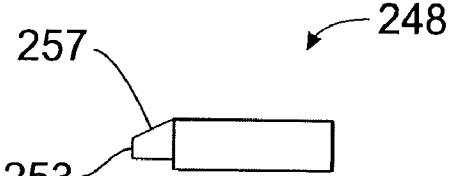
FIG. 16D is an end view of the retainer.
Figure 16B:
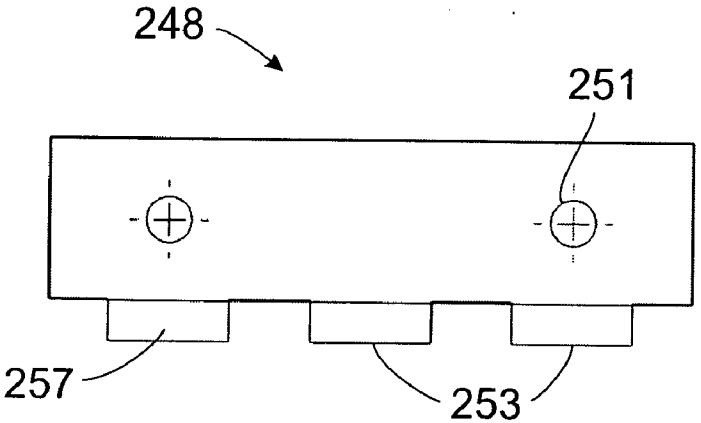
FIG. 16B is a plan view of the retainer.
Figure 16C:
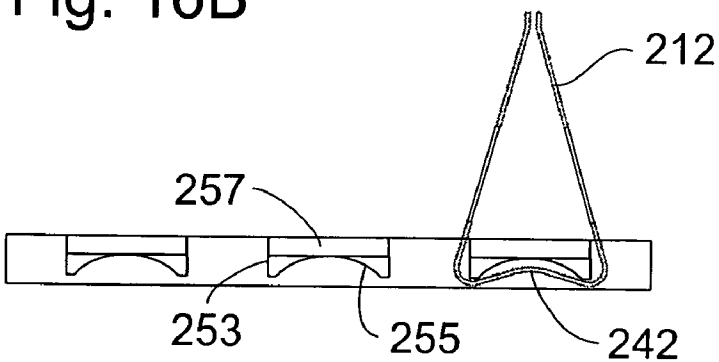
FIG. 16C is an elevational view of the retainer.

The clamps 212 are held in position on the chassis 214 by a pair of retainers 248, as detailed in FIGS. 16A–16D. Each retainer is securable to the chassis 212 in any convenient manner, but as shown, holes 251 are provided through which fasteners 249 (shown in FIGS. 11–14) can be inserted. The retainer 248 is provided with a plurality of spaced-apart tabs 253, each of which being insertable into an open end of a clamp 212 so that together with the opposed retainer's corresponding tab 253, the clamp 212 can be held in place on the chassis, as shown best in FIG. 14. To this end, the shape of the tab 253 may be configured, and particularly the underside 255, to conform to the shape of the bight 242 of the clamp 212 as shown in FIG. 16C. The tabs may also have a bevelled upper edge 257 to enable the tabs 253 to be inserted further into the clamp 212 without interfering with the cam wheels 224. The spacing of the tabs 253 corresponds with the desired spacing of the clamps 212.

The cam wheels 224, detailed in FIGS. 17A–17D, are similar to the cam wheels 24 of the FIG. 1 embodiment. When viewed along its axis (FIG. 17D), the cam wheel 224 may have a circular/cylindrical configuration of its outer surface 281, for ease of manufacture. The cam wheel 224 includes an aperture 272 by which the cam wheel 224 can be mounted on the cam shaft 228. The shape of the aperture 272 and the matching cross-section of the cam shaft 228 are selected so as to enable rotation to be imparted from the shaft 228 to the cam wheels 224. As shown, the square configuration will serve to prevent the cam wheels 224 from rotating relative to the cam shaft 228. The aperture may be centrally located but may also be effectively offset, the purpose of which will be described in greater detail hereinbelow.

Figure 17A:
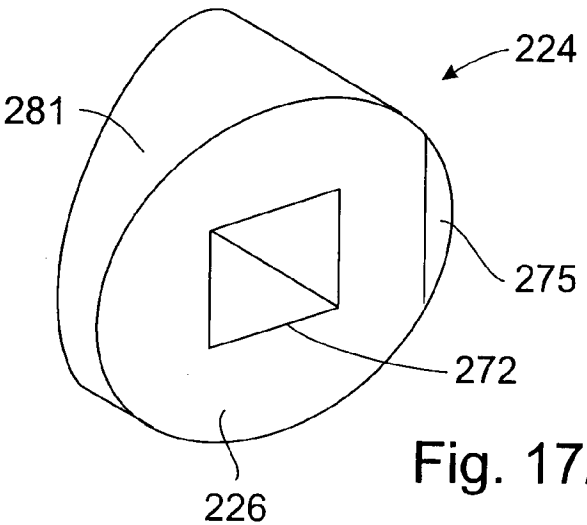
FIG. 17A is a perspective view of one of the cam wheels of the clamping cartridge of FIG. 11.
Figure 17B:
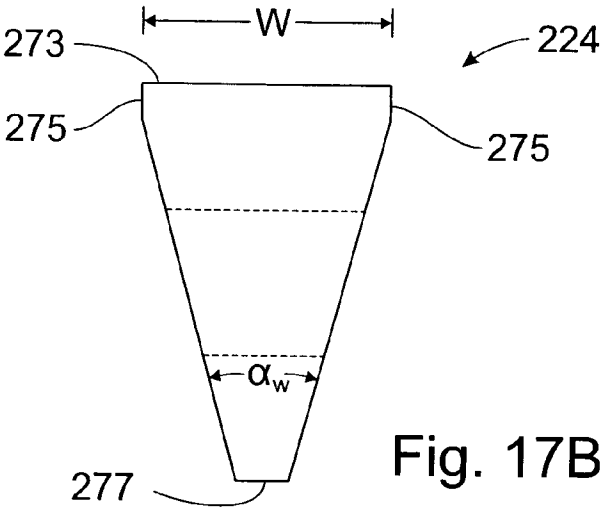
FIG. 17B is an elevational view of the cam wheel of FIG. 17A.
Figure 17D:
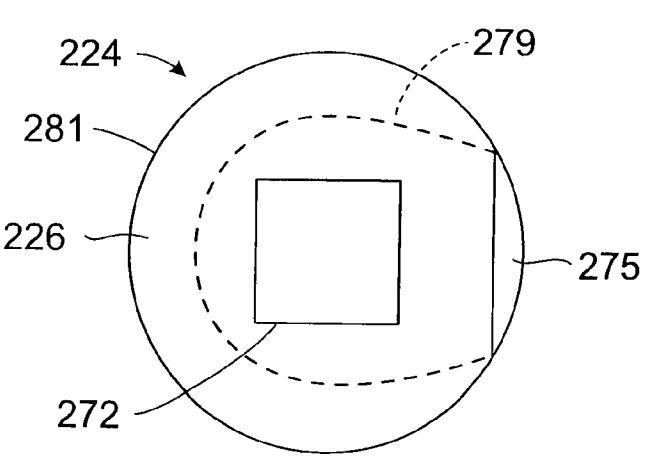
FIG. 17D is a side elevational view of the cam wheel of FIG. 17A.
Figure 17C:
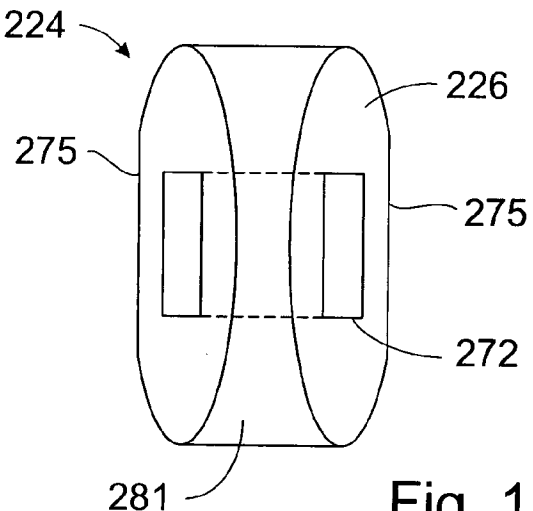
FIG. 17C is a plan view of the cam wheel of FIG. 17A.
Figure 19:
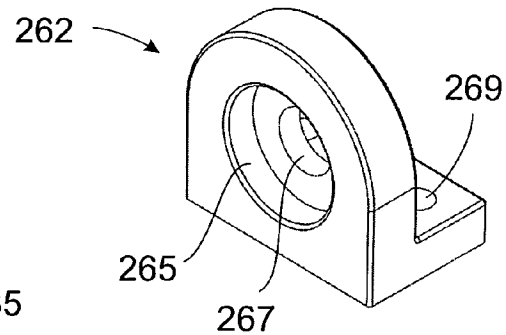
FIG. 19 is a perspective view of one of the pair of bearing blocks used to support the cam shaft of the compact clamping cartridge.

The longitudinal ends of the cam wheels 224 are provided with angled surfaces 226, resulting in the cam wheel 224 having a tapered transverse shape as shown in FIG. 17B. The taper angle $\alpha_w$ of the cam wheel 224 is preferably the same as the included angle $\alpha_c$ of the clamp 212 when in its relaxed state, which will allow maximum initial contact surface area between the cam wheel 224 and the interior wall 221 of jaw 216. However, taper angle $\alpha_w$ can be greater or less than included angle $\alpha_c$, depending on the opening requirements of the clamp 212. To provide maximum openability, the width W of the wider side 273 of cam 224 should extend substantially to the interior walls 221 of the jaws 216 of clamp 212 near its bight 242 when the clamp 212 is in its closed position. Preferably, the angled surface 226 does not extend entirely to the wider side 273 of cam 224, thereby providing a flat cam surface area 275, which appears "bevelled" in FIG. 17A, to permit greater pressure distribution as the cam surface 275 moves relative to the interior wall 221 of the jaw 216 when the cam wheel 224 is rotated to open and close the clamp 212.

One cam wheel 224 is provided for each clamp 212, which, when compared with the clamping cartridges 10 or 120, reduces the number of cam wheels by one for any given number of clamps. The cam wheels 224 may be made from any suitable material such as metal (steel, aluminum, etc.), hard plastics, Teflon™, etc. and they can be machined, stamped, injection molded, or made by any other suitable method of manufacture. The material should provide mechanical robustness, and a reasonable life-time under friction. The materials for the cam wheels 224 can be chosen to have a sufficiently high coefficient of friction relative to the clamp material such that the cam wheels 224 will remain in whatever position they are in when rotation of the shaft 228 is stopped. Alternatively, the chosen materials can have a sufficiently low coefficient of friction whereby the pressure exerted by the clamping jaws 216 on the cam surfaces 275 causes the cam wheels 224 to rotate toward the clamp-closed position, thereby resulting in a clamping cartridge 210 which is normally biased in the closed position.

Figure 18:
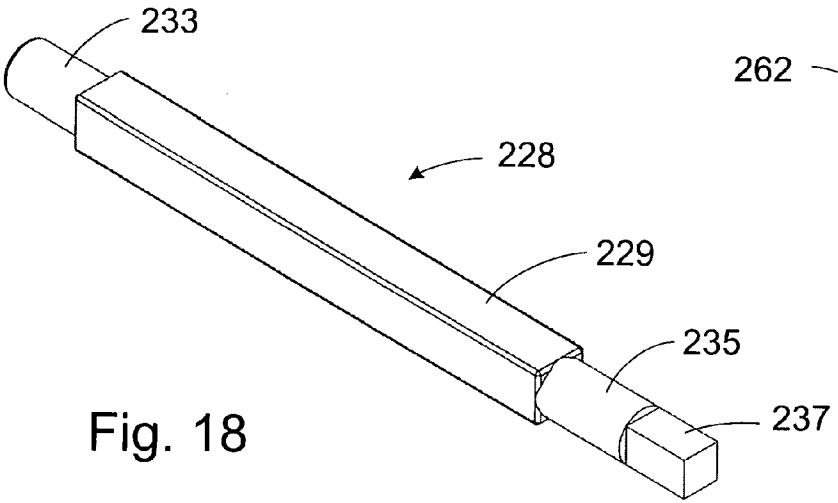
FIG. 18 is a perspective view of the cam shaft of the compact clamping cartridge.

The details of the cam shaft 228 are shown in FIG. 18. The shaft 228 has a central section 229 on which the cam wheels 224 are disposed. As indicated above, the central section 229 has a cross-sectional shape, in this case generally square, to sufficiently match the apertures 272 in the cam wheels 224 to prevent relative rotation therebetween yet enable the cam wheels 224 to be slidably positioned at selective locations corresponding to the clamp spacing. The inwardly biasing forces of the jaws 216 against the cam wheel 224 will cause the cam wheel 224 to be substantially self-centering with respect to the clamp 212, so there is no requirement to rigidly secure the cam wheels 224 to the shaft 228 or to be overly concerned about spacing tolerances during assembly. The shaft 228 may be made from any suitable square stock material whose ends 233, 235 are turned to accommodate bearings 264 for rotationally supporting the shaft 228 within bearing blocks 262 (see FIG. 19). A lug 237 may be provided at one end 233 of the shaft 228 which is engageable by a handle 231, as shown in FIGS. 11–14, to enable rotation of the shaft 228 and, hence, cam wheels 224 for the opening and closing of the clamps 212. The bearing block 262 has a shouldered recess 265 to accommodate a bearing 264 as seen best in FIG. 14, and, in the case of at least one of the bearing blocks 262, an aperture 267 through which the end 235 and/or the lug 237 can extend so that the lug 237 can be engaged by the handle 231. The bearing blocks 262 are provided with means by which they can be secured to the chassis 214, in this case via holes 269 through which fasteners 263 can be inserted as shown for example in FIG. 14.

Figure 12:
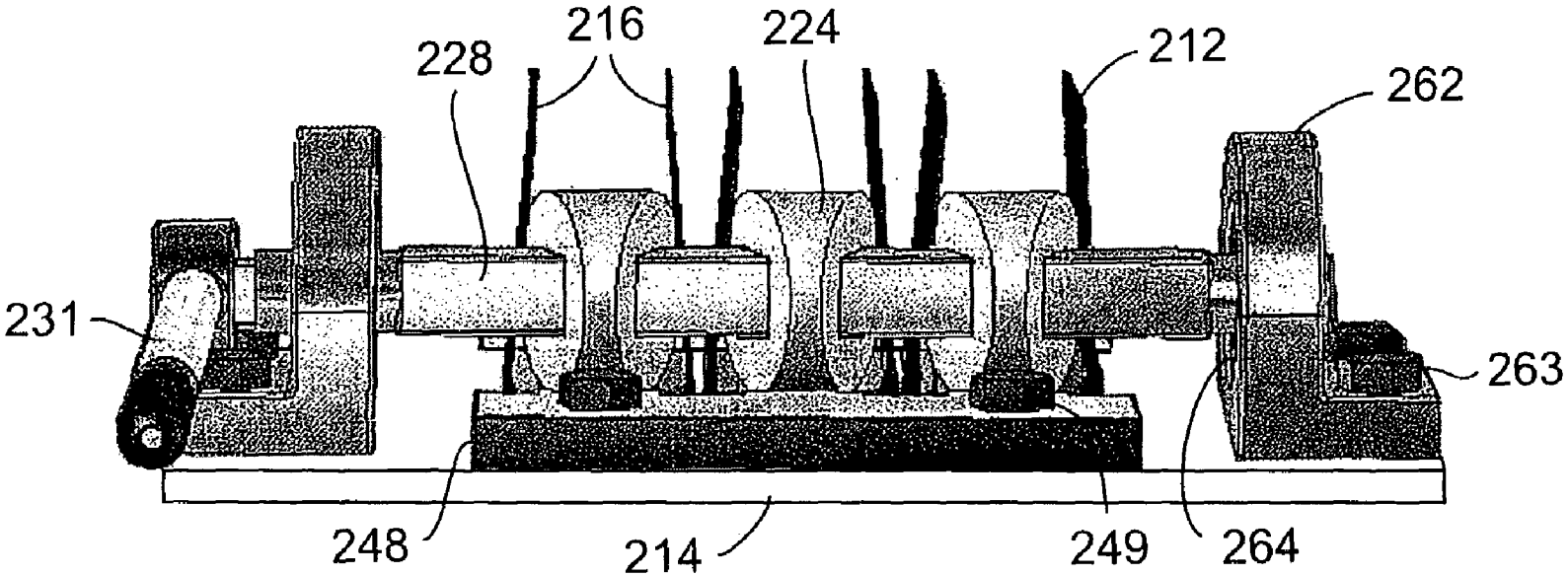
FIG. 12 is a front perspective view of the compact clamping cartridge of FIG. 11, shown in its open condition.
Figure 13:
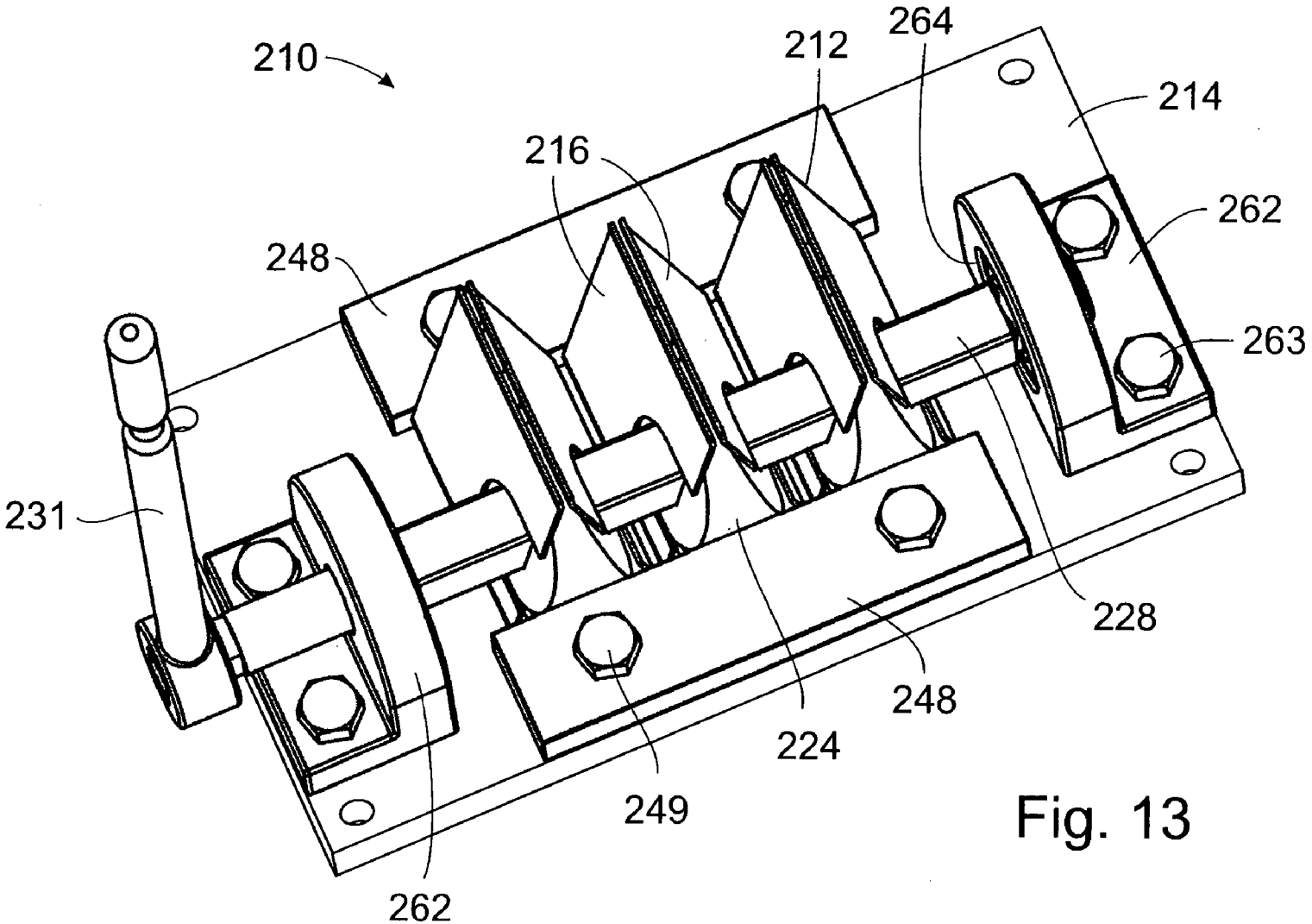
FIG. 13 is a top perspective view of the compact clamping cartridge, shown in its closed condition.
Figure 14:
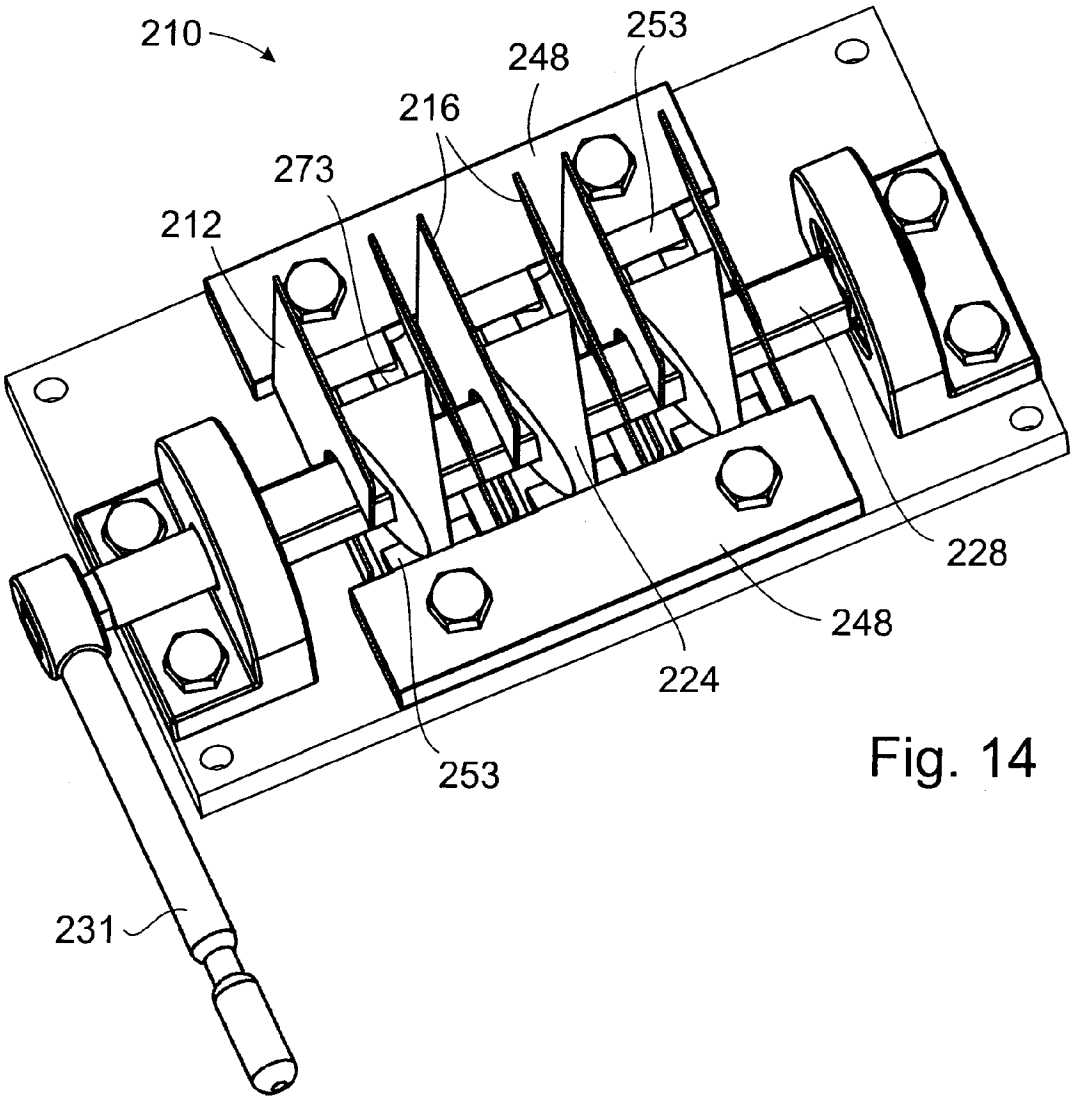
FIG. 14 is a top perspective view of the compact clamping cartridge, shown in its open condition.
Figure 15A:
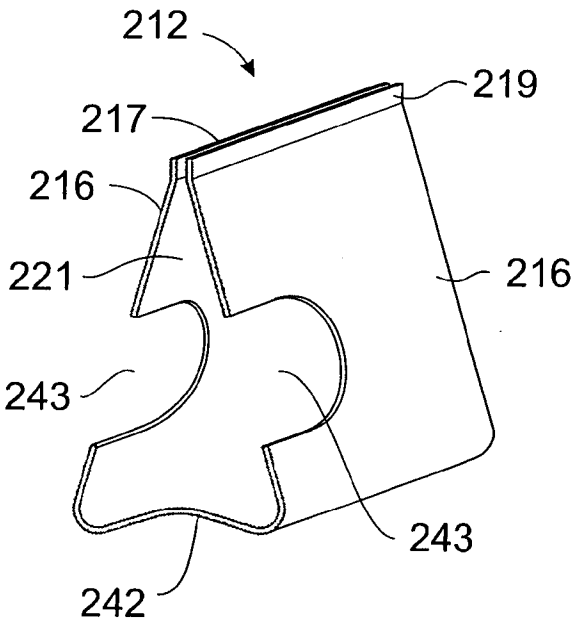
FIG. 15A is a perspective view of one of the clamping mechanisms of the clamping cartridge of FIG. 11.
Figure 15B:
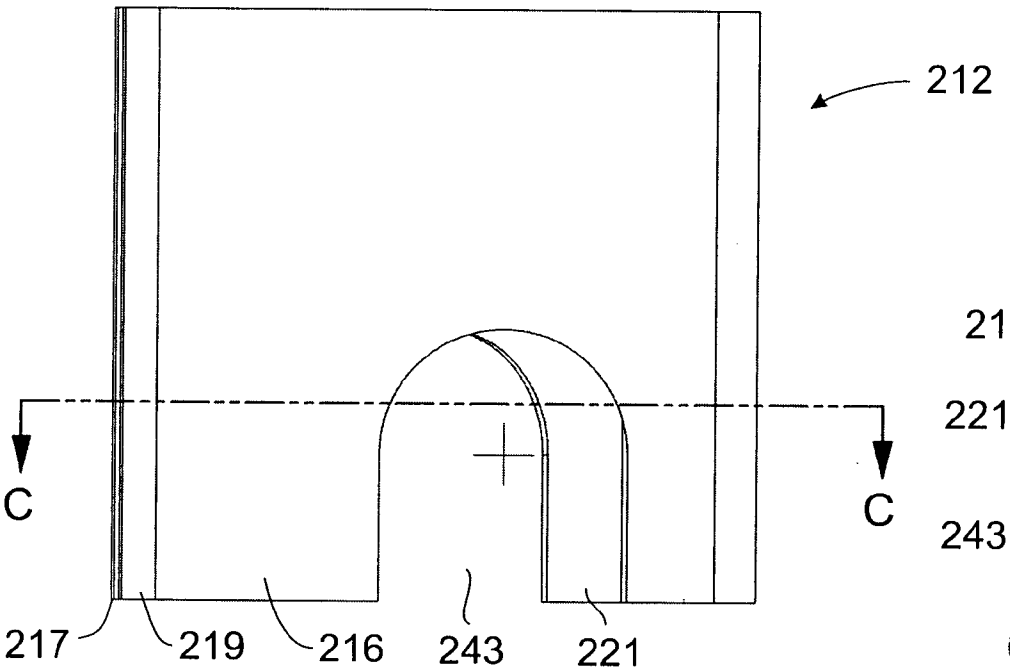
FIG. 15B is a view of the clamp of FIG. 15A as laid on its side.
Figure 15C:
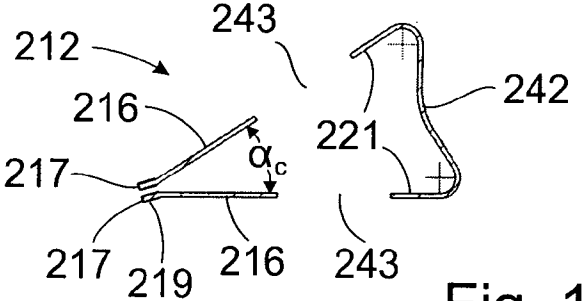
FIG. 15C is sectional view of the clamp taken along lines C—C of FIG. 15B.
Figure 21:
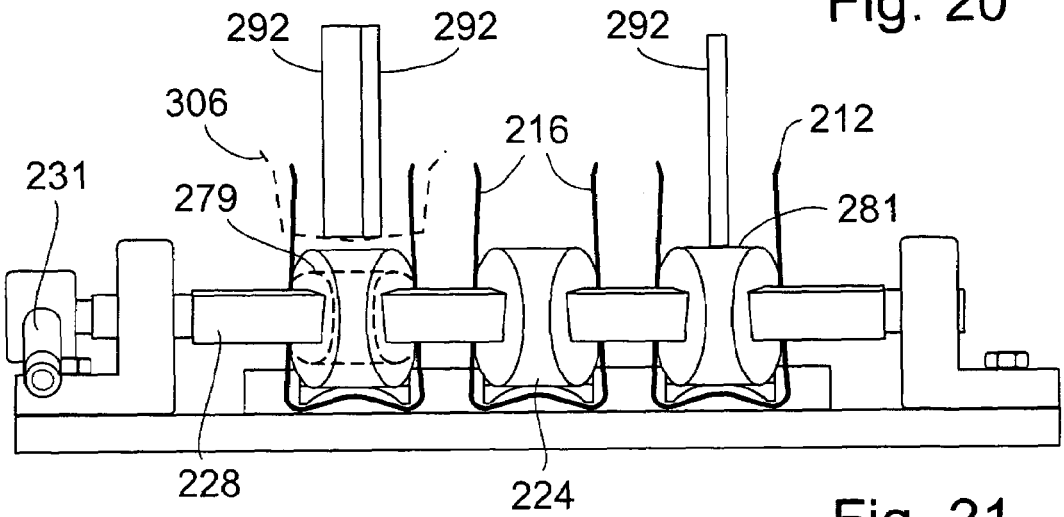

Referring to FIGS. 11–14 and 20–22, to operate the clamping cartridge 210, the cam shaft 204 is rotated by actuating handle 231, which causes the cam wheels 224 which are affixed to the cam shaft 228 to rotate. The rotation of the cams 224 causes the wide side 273, which is nearest the bight 242 of the clamp 212 when in the clamp-closed position as shown in FIGS. 11, 13 and 20, to move in a circular contact path, thereby forcing the cam surface 275 against the interior walls 221 of the jaws 216 of clamp 212 and thus causing their opening as shown in FIGS. 12, 14 and 21.

Preferably, the cam shaft 228 is positioned off-center with respect to the clamps so that when the clamps are in their open condition as seen in FIG. 14, the cam surface 275 of cam wheel 224 is positioned in a substantially balanced location (generally centrally) with respect to the clamp 212, resulting in the jaws 216 of the clamp 212 being substantially in parallel when in their open condition. Depending on the stiffness of the clamp's spring material, the jaws 216 may or may not remain substantially parallel, but regardless, this does not affect the overall operability of the device. The off-centered positioning of the shaft 226 also reduces the extent to which the slots 243 extend into the jaws 216 of the clamps 212, thereby reducing the affect the missing material might have on the jaws' movement.

Provided the width W of the cam wheel 224 is maximized within the clamp geometry as explained above, the maximum opening of the clamps 212 can be achieved with about only 90° of rotation of the handle, although it has been found that maximum opening usually occurs within a 100–110° rotation. This is considerably less than the approximate 180° rotation requirement of the cartridges 10 and 120.

Figure 22:
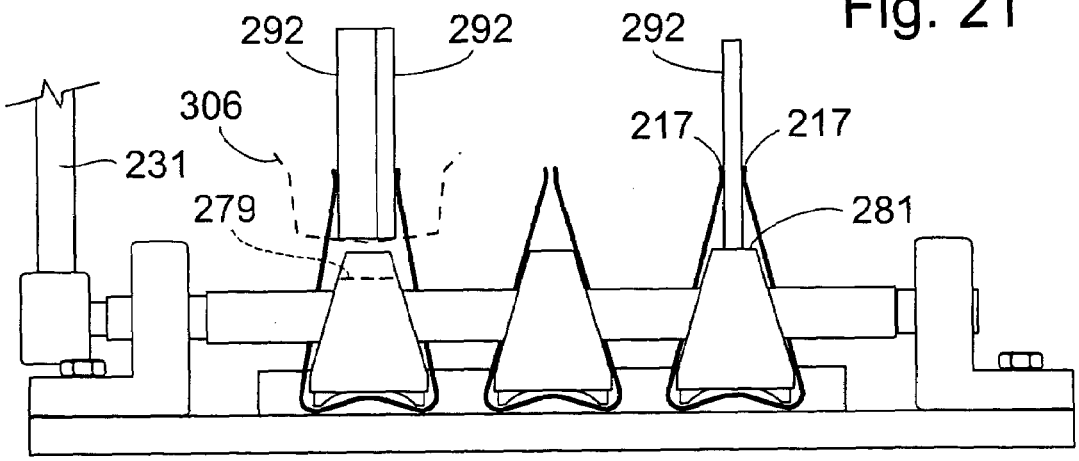

FIGS. 11, 13 and 20 show the compact cartridge 210 in its relaxed, normally closed condition. For better illustration, the foremost retainer clamp retainer has been removed in FIGS. 20–21. At the fully rotated position of handle 231 shown in FIGS. 12, 14 and 21, the jaws 216 of clamps 212 are fully opened to receive therebetween (or release for a FIG. 22, FIG. 21, FIG. 20 sequence) a portion of the edge(s) of the panel-like object(s) 292 (shown schematically). The handle 231 may then be reversely rotated to cause the wide side 273 of the cam wheels 224 to return to its lowermost initial position near the bight 242 of the clamp 212, thereby relaxing the bias-overcoming force and eventually retaining the panel-like objects 292 between the jaws 216 of the clamp 212 as shown in FIG. 22.

Since each of the clamps 212 are individually biased toward a closed position, the clamps 212 will naturally self-adjust to the thickness of the retained panel(s) 292. Accordingly, the clamping cartridge 210 can accommodate a series of different panels comprising panels of different thicknesses and/or a varying number of panels of same or different thickness (the total thickness being less than the designed maximum opening width of the clamp) within each clamp 212 as shown in FIG. 22. This will permit variability in loading or unloading (i.e. random access) and typo-dimensional sequencing for products retained within the clamping cartridge 210. When release or removal of one or more panels 292 is desired, the cam shaft 228 is rotated in the same manner as aforesaid to open the clamps 212 in unison as shown in FIG. 21. When the desired panels have been removed, the cam shaft 228 can be actuated again to close clamps 212 against the remaining panels 292, if any.

Figure 23B:
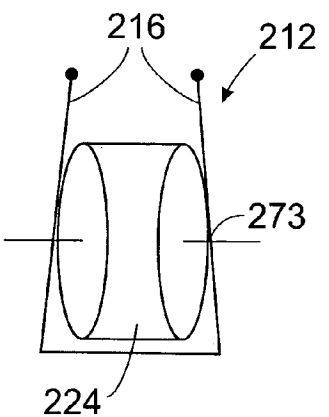
Figure 23A:
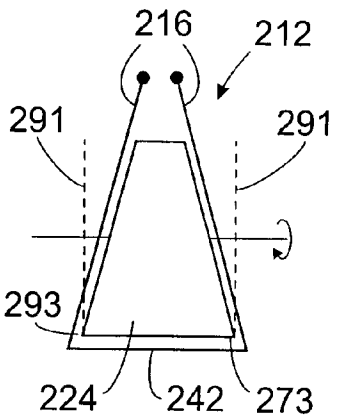

The principles of operation of the camming mechanism of the alternate embodiment are shown schematically in FIGS. 23A–23B and 24A–24B. In FIGS. 23A–23B, a clamp 212 having a tapered generally cylindrical cam wheel 224 within its relaxed, i.e "closed", angled jaws 216 is shown. There is a relative overlap (transverse to the axis of rotation of the cam wheel) between the wider side 273 of the cam wheel 224 and the angled jaws 216. When the cam wheel 224 is rotated, the wider side 273 traces a circular path of rotation 291. Where the path of rotation 291 intersects with the angled jaws 216 of the clamp 212, contact between the wider side 273 of the cam wheel 224 and the interior walls of jaws 216 occurs. Continued rotation causes the wider side 273 of the cam wheel 224 to force the jaws 216 away from one another (as shown in FIG. 23B), thereby overcoming the inward bias of the clamp 212. Generally, the spacing 293 between the wider side 273 of the cam wheel 224 and the angled jaws 216 affects the amount of rotation of the cam wheel 224 before initial contact occurs and the extent to which the jaws 216 can be opened. The maximum extent to which the jaws 216 can open depends on the configuration of the components and of the various geometries involved. Although the examples shown in the drawings have the cam wheels at "bottom dead center" which illustrates the spacing 293, if any. However, where there is a spacing 293, there is no reason the initial rotational position of the cam wheels 224 cannot be at the point of initial contact between cam wheels 224 and the jaws 216 (or beyond depending on the minimum desired opening) to further reduce the required rotational input to go from the "closed" condition to the "open" condition in this regard, stops could be employed to limit the extent of rotation of the cam wheels 224, cam shaft 228 or handle 231.

Figure 24B:
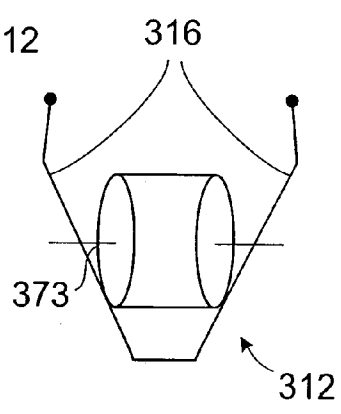
FIGS. 23A–23B and 24A–24B are schematics showing the principles of operation of the camming mechanism on the clamps of the alternate embodiment.
Figure 24A:
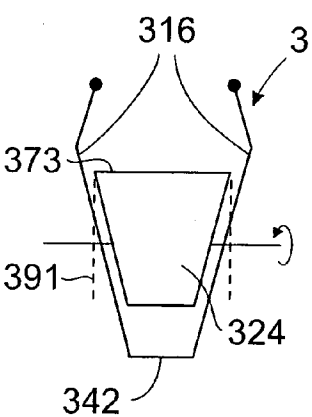

As can be seen in arrangement in FIGS. 24A and 24B, the relaxed jaws 316 of this clamp 312 angle divergently from the bight 342 as opposed to the convergent angling of the jaws 216 from the bight 242 as seen in FIG. 23A. However, provided the cam wheel 324 is oriented such that there is a relative overlap (transverse to the axis of rotation of the cam Wheel) between the wider side 373 of the cam wheel 324 and the angled jaws 316, the path of rotation 391 will still intersect the angled jaws 316 and they will be forced to move under the camming contact as shown in FIG. 24B. Thus, various geometries of the components may be selected to achieve the desired extent of opening and closing of the clamps in the particular application.

The expression "closed" as used herein to describe the state of the clamp does not necessarily imply that the jaws of the clamps or their tips contact each other so as to render the clamp physically closed. Rather, it is used to describe the steady state condition of the clamp absent any external forces. Thus, the clamps may be of the type which are pre-tensioned so that the tips press against one another with a predetermined amount of force or in which the tips of the jaws do not touch when in the clamp is in its relaxed state (such as shown in FIGS. 23A and 24A). The choice as to which to employ will depend on the application and may include such considerations as the expected minimum/maximum thicknesses of the panels to be clamped and the desired clamping force therefor.

The clamping cartridges 10, 120, 210 can be used in a variety of storage and/or packaging systems. The cartridges can be used in a variety of containers like hard (plastic) bins, totes, wooden and even paper (cardboard) structures, as well as on carts, cars, dollies, elevators, conveyors, or in fixed applications (on walls, on floors, on structures of any kind). In one such application shown in FIGS. 25–29, a glass-panel storage rack 300 is realized comprising a frame 302 to which a generally horizontal bottom support 303a and a generally vertical side support 303*b* are attached. At least one clamping cartridge 10 (as shown, or clamping cartridge 120 or 210) is preferably provided in association with each support 303*a*,303*b* such that the clamping mechanisms 12*a* of the horizontal support cartridge(s) 10*a* align in the same plane with the corresponding clamping mechanisms 12*b* of the vertical support cartridge(s) 10*b*. The clamping cartridges 10*a*,10*b* can then be opened as aforesaid so as to enable the edges 304*a*,304*b* of glass panels 305 to be positioned within the clamps 12*a*,12*b*, respectively. The clamping cartridges 10*a*,10*b* can then be closed as aforesaid so as to clampingly retain the glass panels 305 within the rack 300.

When any one of the glass panels 305 is to be removed, the clamping cartridges 10*a*,10*b* are opened and the panels 305 can be removed as desired. Although when the clamping cartridges 10*a*,10*b* are opened, all of the clamping mechanisms release, the edges 304*a*,304*b* of glass panels 305 are still bounded by the clamping arms 16 (jaws) and thus the panels 305 should remain in place until removed. However, it may be desirable to incline the rack 300 to take advantage of gravity to ensure the panels 305 stay in the rack 300 when the clamping cartridges 10*a*,10*b* are opened. In the embodiment shown in FIGS. 25–29, the frame 302 is maintained generally upright while the bottom and side supports 303*a*, 303*b* are tilted as shown by angle a in FIGS. 25, 26 and 29.

The rack 300 may also include separate seating/supporting devices 306 (shown best in FIGS. 27, 28 and 29) for the panel whereby the weight of the panels is supported thereby. The clamping cartridges 10*a*,10*b* are positioned such that the jaws 20 are engageable with the edge portion 304*a*,304*b* of the panels 304 without the panels'weight resting on or abutting against the bight 42 of the clamps 12 as shown, for example, in FIG. 27. In this regard, the rack 300 separates the gripping/clamping task/function from the gravitational, supporting functions. The use of separate seating/supporting devices 306 reduces the need for more robust clamps and provides more economical cushioning and surface distribution capability versus having it built into the clamps. As shown, the seat/supports 306 have a multiple-U-shaped cross-section seen best in FIG. 29, which is attachable to convenient locations on the bottom and side supports 303*a*, 303*b*, wherein the parallel channels 308 are aligned generally with the clamps 12 of the clamping cartridges 10. The seat/supports may also be built directly onto the cartridge. In the case of the lower seat/supports 306*a* on the bottom support 303*a*, the edge bearing surfaces 310 extend above the bights 42 of the clamps 12 of the cartridges 10*a* but not above the upper ends of the arms 20, whereas the edge bearing surfaces 310 of the side seat/supports 306*b* on the side support 303*b*, extend inwardly of the bights 42 of the clamps 12 of the cartridges 10*b* but not beyond the upper ends of the arms 20.

Figure 25:
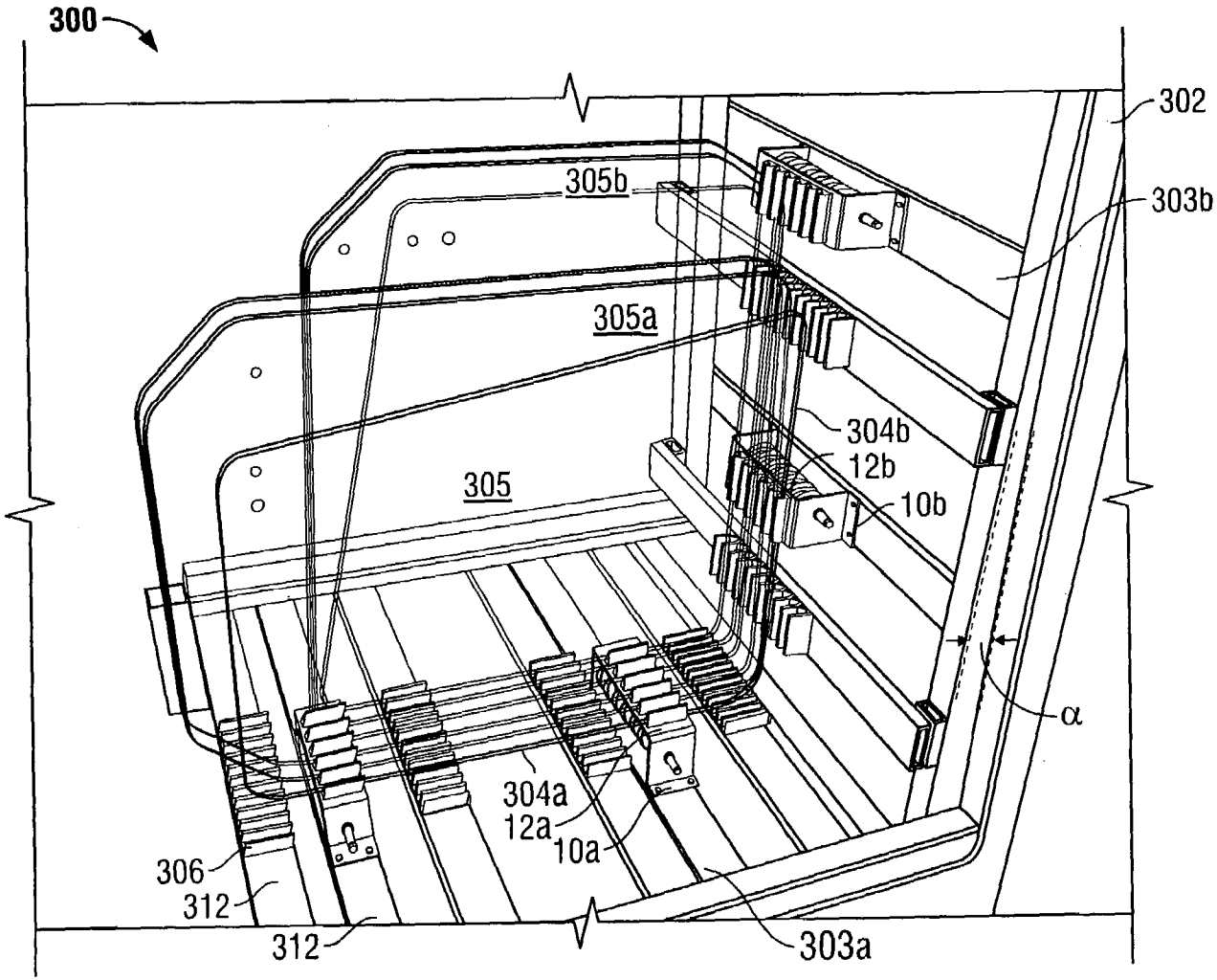
FIG. 25 is a perspective view of a transportation/storage rack illustrating the use of the clamping cartridge of FIG. 1A.
Figure 26:
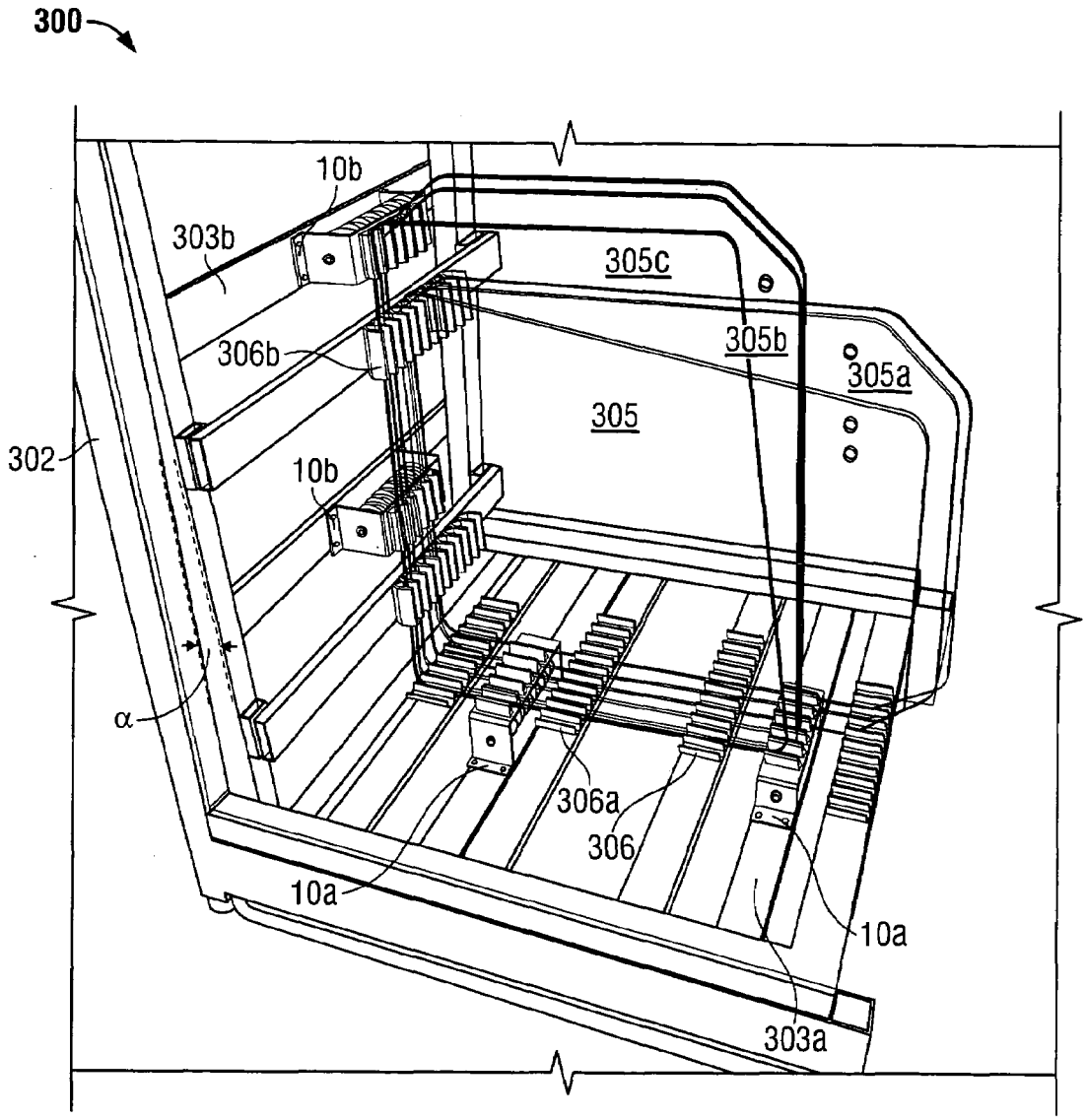
FIG. 26 is an alternate perspective view of the rack generally opposite to that shown in FIG. 25.
Figure 27:
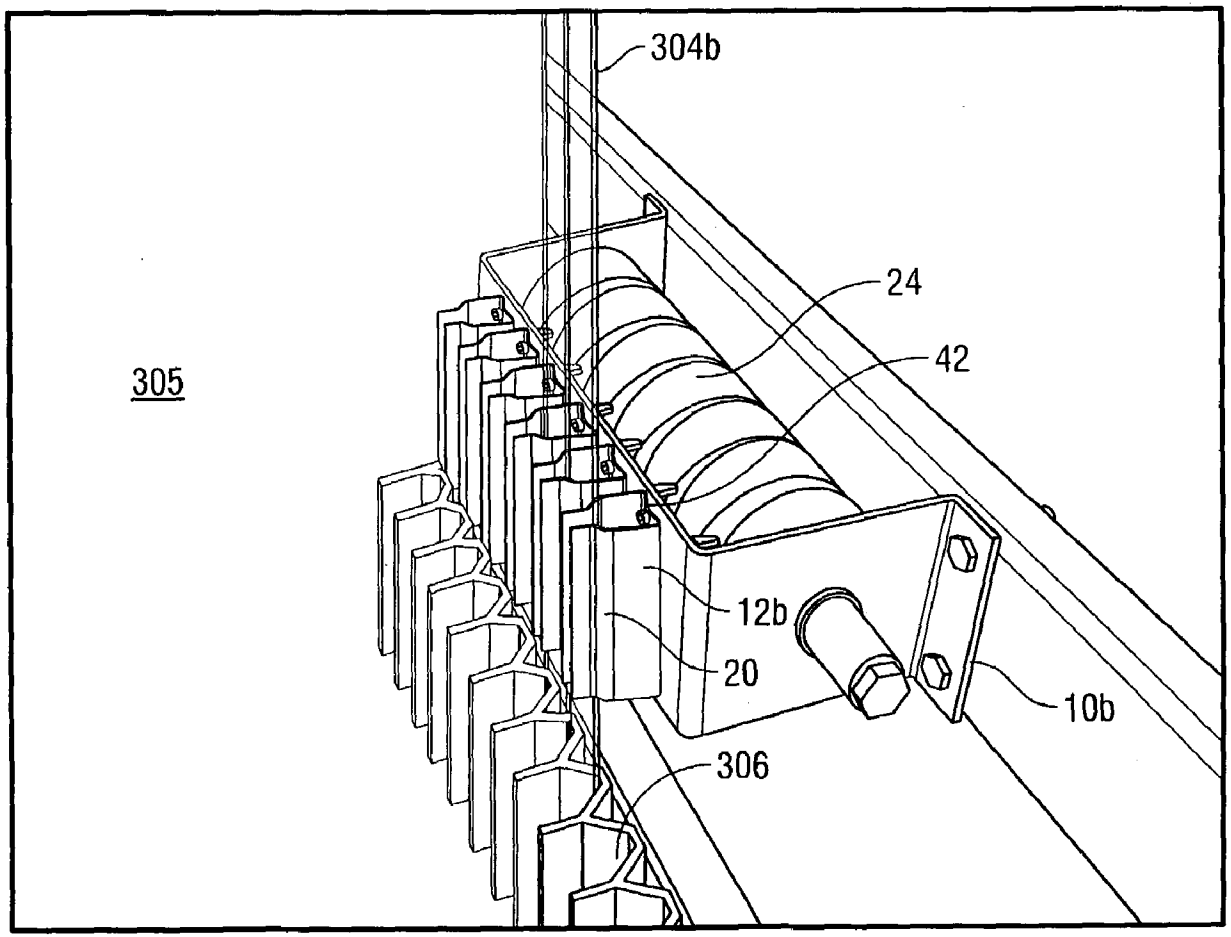
FIG. 27 is a close-up of one of the rack's side clamping cartridges.
Figure 28:
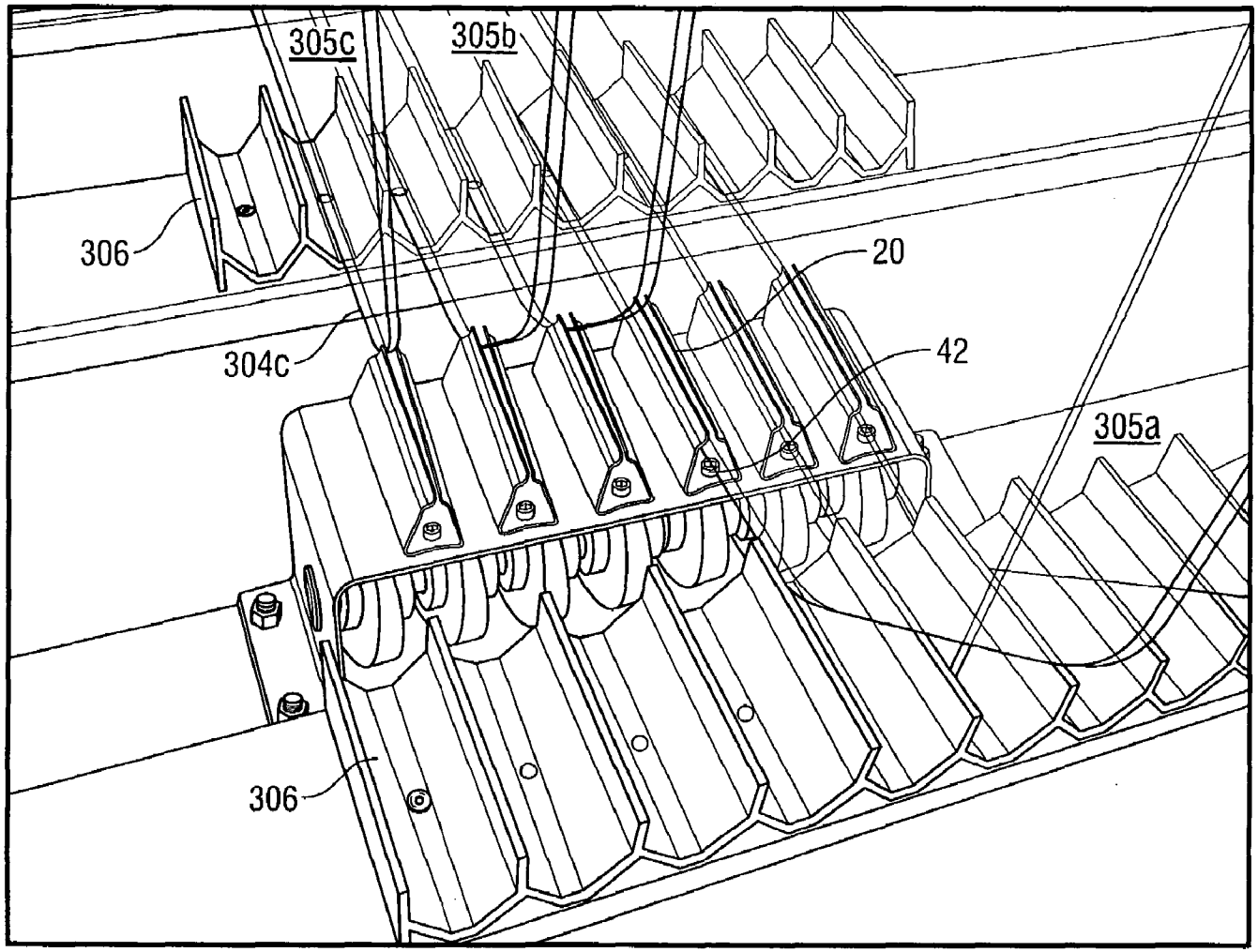
FIG. 28 is a close-up of one of the rack's bottom clamping cartridges.
Figure 29:
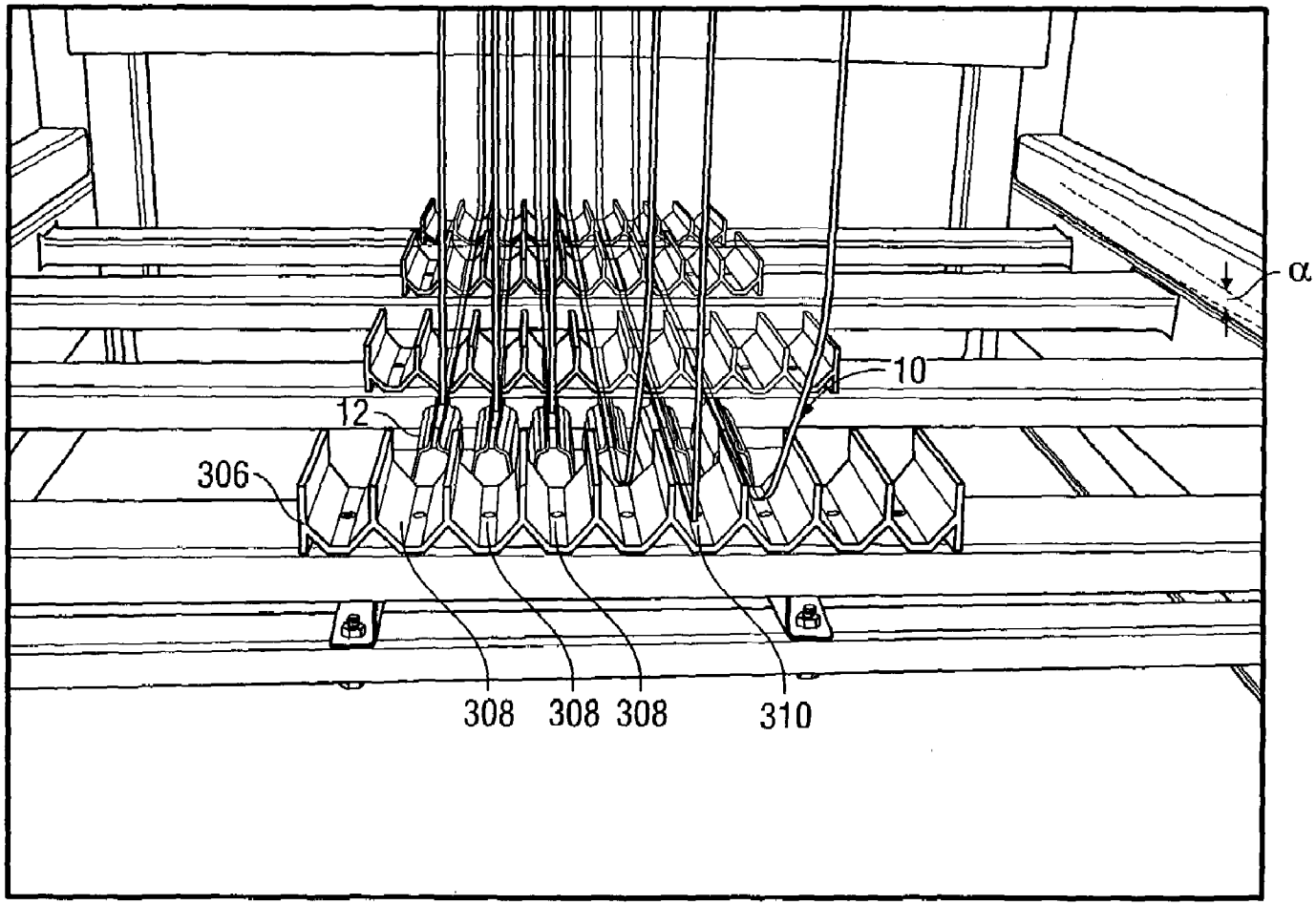
FIG. 29 is a close-up, perspective end view of the lower portion of the rack.

Depending on the arrangement of clamping cartridges 10 and seat/supports 306 in a given rack 300, it may be possible to use the rack 300 to store or transport not only a plurality of identical articles, but also differing articles. As can be seen in FIGS. 25 and 26, different sets of glass panels 305*a*,305*b*,305*c* are retained in the rack 300 although only three of the four clamping cartridges 10 are used, only two of which are common to all sets of glass panels 305*a*,305*b*, 305*c*. FIG. 28 shows how the seat/supports 306 cradle the remote (from the clamps) edges 304*c* of the glass panel 305*c*. Depending on the clamping strength and the article to be clamped, it may only be necessary to employ one clamp 12 per article (hence a single clamping cartridge 10) and, where necessary, utilize one or more aligned seat/supports 306 to support and prevent movement of non-clamped edges.

The seat/supports 306 can be made of any appropriate material bearing in mind the articles expected to be transported or stored in the rack 300. As shown, the seat/supports 306 are made from an extruded plastics material.

Advantageously, the bottom and side supports 303*a*,303*b* can comprise a plurality of slats 312 on which the clamping cartridges and seat/supports 306 are mounted.

By having the slats 312 moveable/adjustable with respect to the frame 302 and hence the spacing between adjacent clamps, the rack 300 can readily be adapted to accommodate a wide variety of articles.

Depending on the number of clamping cartridges employed in any one rack and their accessibility, it may be advantageous to provide a linkage mechanism (not shown) to operate them simultaneously or to utilize power-driven shafts with an associated control unit (not shown) to selectively rotate the shafts individually or simultaneously.

Since the clamping cartridges 10, 120, 210 function in the same general manner, their use in a rack 300 would be the same as explained above with clamping cartridge 10. However, since the actuating mechanism for opening and closing the clamps 212 is contained substantially within the height of the clamp 212 from the bight 272 to the tips 217 (with the exception of the removable handle 231), a much more compact clamping cartridge is realized which can serve to reduce the size of the rack 300 for given panel sizes. Due to the placement of the cams 224 within the clamps 212, there may be a loss in the depth to which a panel 292 can be inserted, depending on clamp dimensions. This is not thought to have a significant effect on the clamping capability of the cartridge since by design it is normally only the tips 217 that engage the edge of the panels 292. Preferably, separate seating/supporting devices 306 (as shown in phantom in the leftmost clamp in FIGS. 21 and 22) are employed to support the panels 292. Where the cam wheel 224 is designed to support the panel 292 (as shown in the rightmost clamp 212 in FIGS. 21 and 22), the outer surface 281 is preferably cylindrical (or at least the portion of the surface over which contact occurs) and the aperture 272 is centrally located to avoid inducing motion to the panels while clamping/unclamping. Otherwise, where separate seating/supporting devices 306 are employed, the outer surface can be suitably shaped such as shown by phantom line 279 in FIGS. 17D, 20 and 21 to increase the effective depth of the clamp 212.

While there has been shown and described herein a clamping cartridge for panel-type products and a rack for its application, it will be appreciated that various modifications and or substitutions may be made thereto without departing from the spirit and scope of the invention. For example, while the compact clamping cartridge 210 has been illustrated as being affixed to a chassis 214, the various components could be bolted directly to predetermined locations in on the shipping rack. Furthermore, the separate seating/supporting devices 306, if used to support the weight of the panels in the rack 300, can be attached directly to the cartridge and aligned with the corresponding clamps for a complete "bolt & go" solution within the rack.

I claim:

1. A clamping cartridge for releasably clamping a plurality of panel-type articles in generally parallel spaced-apart manner comprising:

a plurality of spaced-apart clamps, said clamps being generally oriented perpendicular to their direction of spacing and each having a pair of relatively movable jaws;

actuation means operable in association with said clamps for causing the jaws of all said clamps to move in unison relative to one another, said actuation means comprising a cam operable between the jaws of each clamp whereby movement of the cam causes the relative movement of said jaws;

said jaws being normally biased so as to be individually self-adjusting to the presence of an edge of one or more panel-type articles placed therebetween.

2. A clamping cartridge as claimed in claim 1, wherein said jaws of each clamp are biased towards one another such that they resist opening and return to a closed or substantially closed condition in absence of external forces.

3. A clamping cartridge as claimed in claim 2, wherein the cams are rotatable and have a cam surface engageable with a respective interior wall of said jaws of each clamp.

4. A clamping cartridge as claimed in claim 3, wherein said cam is tapered transversely with respect to an axis of said cam and said jaws are angled relative to the cam such that there is a relative overlap transverse to the axial direction between a wider side of the cam and the angled jaws, wherein when the cam is rotated, the wider side traces a circular path of rotation which intersects with the angled jaws of the clamp to force the jaws to open and to permit them to close as the cam is rotated.

5. A clamping cartridge as claimed in claim 4, wherein said cams are disposed on a rotatable cam shaft.

6. A clamping cartridge as claimed in claim 5, wherein said cam shaft is disposed generally in the direction of spacing of said clamps.

7. A clamping cartridge as claimed in claim 6, wherein the cam shaft projects though an aperture or slot in said jaws of said clamps.

8. A clamping cartridge as claimed in claim 4, wherein the pairs of jaws have respective pairs of tips, and wherein at the location of overlap between the wider side of the cam and the angled jaws, the jaws angle convergently towards the tips.

9. A clamping cartridge as claimed in claim 4, wherein the pairs of jaws have respective pairs of tips, and wherein at the location of overlap between the wider side of the cam and the angled jaws, the jaws angle divergently towards the tips.

10. A clamping cartridge as claimed in claim 7, wherein the clamps are arranged along a chassis, and bearing means are provided to rotatably mount said cam shaft to said chassis.

11. A clamping cartridge as claimed in claim 10, wherein retaining means is provided for retaining the clamps in their spaced apart relation along the chassis.

12. A clamping cartridge as claimed in claim 11, wherein the jaws of each clamp extend from a common bight and the clamps have open ends, said retaining means comprising a pair of retainers disposed in parallel in the direction of spacing of said clamps and wherein said pair of retainers have inwardly projecting tabs insertable in the open ends of the clamp so as to enable the bight of the clamp to be confined against the chassis when said retainers are secured to said chassis.

13. A clamping cartridge as claimed in claim 5, wherein an aperture is provided in said cam through which said cam shaft is insertable, said aperture having a shape generally corresponding to the cross-sectional shape of the cam shaft so as to prevent relative rotational movement therebetween and to allow said cams to be axially slidable along said cam shaft.

14. A clamping cartridge as claimed in claim 2, wherein the clamp is made from a material having a spring stiffness which provides the biasing.

15. A clamping cartridge as claimed in claim 1, further comprising seating means aligned with said clamps for supporting said one or more panel-type articles while said clamps clamp the edges thereof.

16. A transportation or shipping package comprising one or more clamping cartridges as claimed in claim 1 used for clamping, spacing, separating and/or supporting one or more panel-type articles to be contained therein.

17. The transportation or shipping package as claimed in claim 16, further comprising seating means which cooperate with said one or more clamping cartridges for supporting said articles.

18. The transportation or shipping package as claimed in claim 16, wherein:

the clamping cartridges are provided in pairs, one clamping cartridge of each said pair being oriented generally perpendicularly to the other for clamping adjacent perpendicular edges of said articles.

19. The transportation or shipping package as claimed in claim 18, wherein:

the clamping mechanisms of one of the clamping cartridges of each perpendicular pair align in the same plane with the corresponding clamping mechanisms of the other clamping cartridge of the pair.

20. The transportation or shipping package as claimed in claim 18, wherein:

the perpendicular clamping cartridge pairs are disposed at an angle to the transportation or shipping package.

21. A clamping cartridge for releasably clamping a plurality of panel-type articles in generally parallel spaced-apart manner comprising:

a plurality of spaced-apart clamps, said clamps being generally oriented perpendicular to their direction of spacing and each having a pair of relatively movable jaws;

actuation means operable in association with said clamps for causing the jaws of all said clamps to move in unison relative to one another, said actuation means comprising a cam operable directly on the jaws of each clamp whereby movement of the cam causes the relative movement of said jaws;

said jaws of each clamp being normally biased so as to be individually self-adjusting to the presence of an edge of one or more panel-type articles placed therebetween.

* * * * *